US010374346B2

(12) United States Patent
Doi et al.

(10) Patent No.: US 10,374,346 B2
(45) Date of Patent: Aug. 6, 2019

(54) MOVABLE CONNECTOR

(71) Applicant: IRISO ELECTRONICS CO., LTD., Kanagawa (JP)

(72) Inventors: Takashi Doi, Kanagawa (JP); Hiroaki Kobayashi, Kanagawa (JP); Yoshiyuki Ogura, Kanagawa (JP); Daichi Shimba, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 15/801,542

(22) Filed: Nov. 2, 2017

(65) Prior Publication Data

US 2018/0145436 A1 May 24, 2018

(30) Foreign Application Priority Data

Nov. 24, 2016 (JP) ..... 2016-228143

(51) Int. Cl.
*H01R 13/64* (2006.01)
*H01R 12/00* (2006.01)
(Continued)

(52) U.S. Cl.
CPC ..... *H01R 12/91* (2013.01); *H01R 12/716* (2013.01); *H01R 13/6315* (2013.01); *H01R 12/732* (2013.01)

(58) Field of Classification Search
CPC H01R 13/6315; H01R 12/716; H01R 13/631; H01R 13/518; H01R 13/514; H01R 12/91; H01R 13/73
See application file for complete search history.

(56) References Cited

U.S. PATENT DOCUMENTS 9,022,801 B2 * 5/2015 Endo ..... H01R 13/533 439/527
2010/0297893 A1 11/2010 Masuda et al.
(Continued)

FOREIGN PATENT DOCUMENTS

JP 06-325825 A 11/1994
JP 6-325825 A 11/1994
(Continued)

OTHER PUBLICATIONS

Office Action from Japanese Patent App. No. 2016-228143 dated Oct. 20, 2017.
(Continued)

*Primary Examiner* — Xuong Chung Trans
(74) *Attorney, Agent, or Firm* — Cermak Nakajima & McGowan LLP; Tomoko Nakajima

(57) ABSTRACT

To prevent damage from being caused in a movable piece caused by inclination of the movable housing of a floating connector. Providing an inclined piece portion in a movable piece of a plug terminal of a plug connector from a middle side to an outer edge side of a bottom wall portion of a movable housing, the inclined piece portion obliquely extending so as to gradually be distanced away form a substrate. Since the inclined piece portion is distanced away from the substrate by the amount of inclination of the inclined piece portion when the movable housing is inclined, a risk of the movable piece impinging against the substrate can be reduced.

6 Claims, 22 Drawing Sheets

(51) Int. Cl.

| | |
|---|---|
| ***H01R 12/91*** | (2011.01) |
| ***H01R 12/71*** | (2011.01) |
| ***H01R 13/631*** | (2006.01) |
| *H01R 12/73* | (2011.01) |

(56) References Cited

U.S. PATENT DOCUMENTS

| | | | |
|---|---|---|---|
| 2014/0213115 | A1 | 7/2014 | Kimura |
| 2015/0044919 | A1 | 2/2015 | Kimura |

FOREIGN PATENT DOCUMENTS

| | | | |
|---|---|---|---|
| JP | 3007812 | U | 12/1994 |
| JP | 2007-165128 | A | 6/2007 |
| JP | 2010-272320 | A | 12/2010 |
| JP | 2013-016363 | A | 1/2013 |
| JP | 2013-016363 | A | 7/2013 |
| JP | 2014-067706 | A | 4/2014 |
| KR | 10-1185545 | B1 | 9/2012 |

OTHER PUBLICATIONS

Extended European Search Report for European Patent App. No. 17200154.7 (dated Feb. 23, 2018).
Office Action from Japanese Patent App. No. 2016-228143 (dated Oct. 3, 2017).

* cited by examiner

MOVABLE CONNECTOR

BACKGROUND OF THE INVENTION

1. Field of the Invention

The present disclosure relates to a movable connector in which a movable housing is capable of being displaced with respect to a fixed housing mounted on a substrate.

2. Description of the Related Art

There is known a movable connector including a fixed housing fixed to a substrate, a movable housing including a bottom surface that opposes a substrate and to which an object to be connected is fitted and connected, and terminals each including a movable piece that elastically supports the movable housing so as to allow the movable housing to be displaced with respect to the fixed housing. The movable connector is known as a floating connector in which the movable housing is capable of being displaced with respect to the fixed housing. The above floating connector has a function that is capable of, when fitting and connecting the object to be connected thereto, properly fitting and connecting the object to be connected thereto even in a case in which the fitting position with respect to the object to be connected is out of position by absorbing the misalignment through displacement of the movable housing. Furthermore, even if used in a vibration environment after being fitted and connected, the displacement between the object to be connected and the substrate can be absorbed with the displacement of the movable housing. Examples of such a floating connector is illustrated in Japanese Unexamined Patent Application Publication No. 2013-16363, FIG. 3 and Japanese Unexamined Patent Application Publication No. 2007-165128, FIG. 3(D).

SUMMARY OF THE INVENTION

In such known floating connectors, a region of each movable piece that opposes the fixed housing as illustrated in Japanese Unexamined Patent Application Publication No. 2013-16363, FIG. 3, and a region of each movable piece that opposes the substrate as illustrated in Japanese Unexamined Patent Application Publication No. 2007-165128, FIG. 3(D) are formed horizontally. Accordingly, there is a risk of the movable piece being damaged in a case in which the movable housing is inclined while the object to be connected is fitted and connected to the movable housing, for example, and the horizontal portion of the movable piece impinges against the fixed housing or the substrate.

The present disclosure has been made in the content of the above conventional technique. An object of the present disclosure is to prevent damage from being caused in a movable piece caused by inclination of a movable housing of a floating connector.

In order to achieve the above object, the present disclosure is configured to have the following characteristics.

A movable connector according to the present disclosure includes a fixed housing fixed to a substrate, a movable housing fitted and connected to an object to be connected, and a terminal including a movable piece that elastically supports the movable housing so as to allow the movable housing to be displaced with respect to the fixed housing. In the movable connector, the movable piece includes an inclined piece portion that obliquely extends from a middle side of a bottom surface of the movable housing toward a lateral surface of the movable housing so as to gradually be distanced away from an opposing surface of the substrate or an opposing surface of the fixed housing that opposes the bottom surface.

According to the present disclosure, since the inclined piece portion is distanced away from the opposing surface of the substrate or the opposing surface of the fixed housing by the amount of inclination of the inclined piece portion in a case in which the movable housing is inclined when the movable housing is fitted and connected to the object to be connected, a risk of damage being caused by the movable piece impinging against the substrate or the fixed housing can be reduced. Furthermore, even if the movable housing is inclined while in a state in which the object to be connected and the movable housing are fitted and connected to each other, since the inclined piece portion is distanced away from the opposing surface by the amount of inclination of the inclined piece portion, a movable space corresponding to the designed displacement amount of the movable housing can be obtained between the inclined piece portion and the opposing surface.

The movable housing may include a bottom wall that forms the bottom surface, and the bottom wall may include an inclined surface portion that obliquely extends from a middle side thereof towards the outer edge side thereof along the inclined piece portion. Since the present disclosure includes, in the bottom wall of the movable housing, the inclined surface portion that obliquely extends along the inclined surface of the inclined piece portion, the inclined piece portion can be disposed along the bottom wall of the movable housing while obtaining a predetermined movable space between the bottom wall of the movable housing. In such a case, an accommodation groove accommodating the inclined piece portion may be provided in the bottom wall of the movable housing, and the bottom of the accommodation groove may be configured as the inclined surface portion. With the above, since the inclined piece portion of the movable piece is disposed inside the accommodation groove, a shortcircuited connection between adjacent inclined piece portions with a foreign substance can be prevented and the inclined piece portion can be protected from damage caused by contact between another member.

The movable housing may include a displacement restricting protrusion that opposes at least the fixed housing or the substrate, and the displacement restricting protrusion may include a corner edge absent portion in at least a surface opposing the fixed housing or a surface opposing the substrate. According to the present disclosure, by providing the corner edge absent portion in the displacement restricting protrusion, a gap between an end portion of the displacement restricting protrusion and the fixed housing or the substrate can be increased; accordingly, the displacement amount of the inclination of the movable housing can be increased when compared with a case in which no such corner edge absent portion is provided.

According to the movable connector of the present disclosure, since damage caused by the movable piece impinging against the opposing surface of the substrate or the opposing surface of the fixed housing can be prevented even when the movable housing is inclined, by appropriately operating the movable piece, the floating function of the movable housing can be exerted reliably.

DESCRIPTION OF THE PREFERRED EMBODIMENTS

Figure 1:
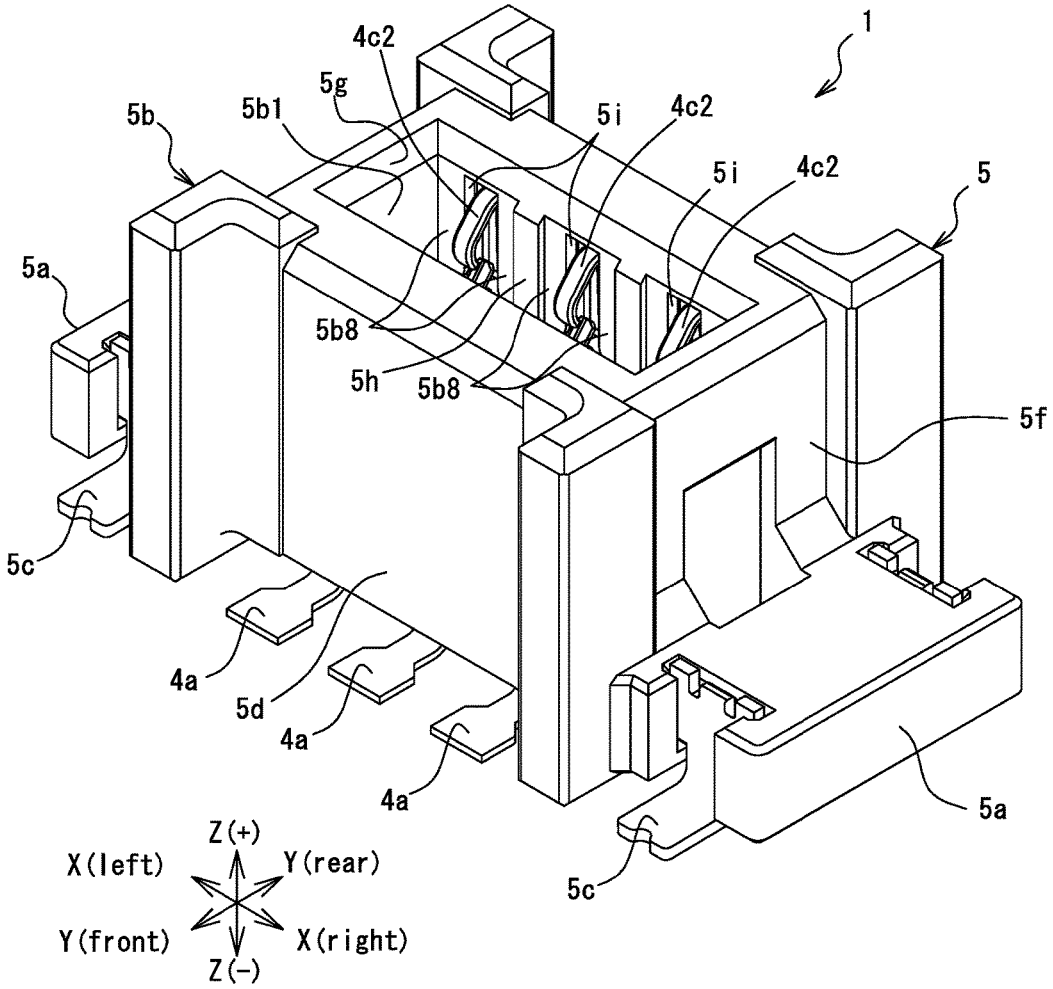
FIG. 1 is an external perspective view illustrating the front side, the right side, and the top side of a socket connector according to an exemplary embodiment.
Figure 2:
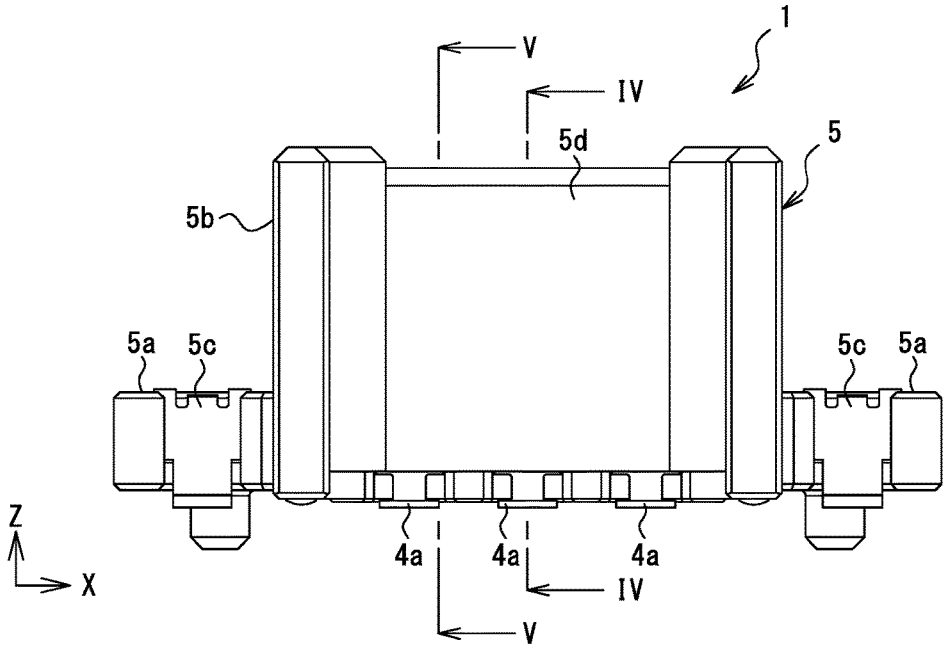
FIG. 2 is a front view of the socket connector in FIG. 1.
Figure 3:
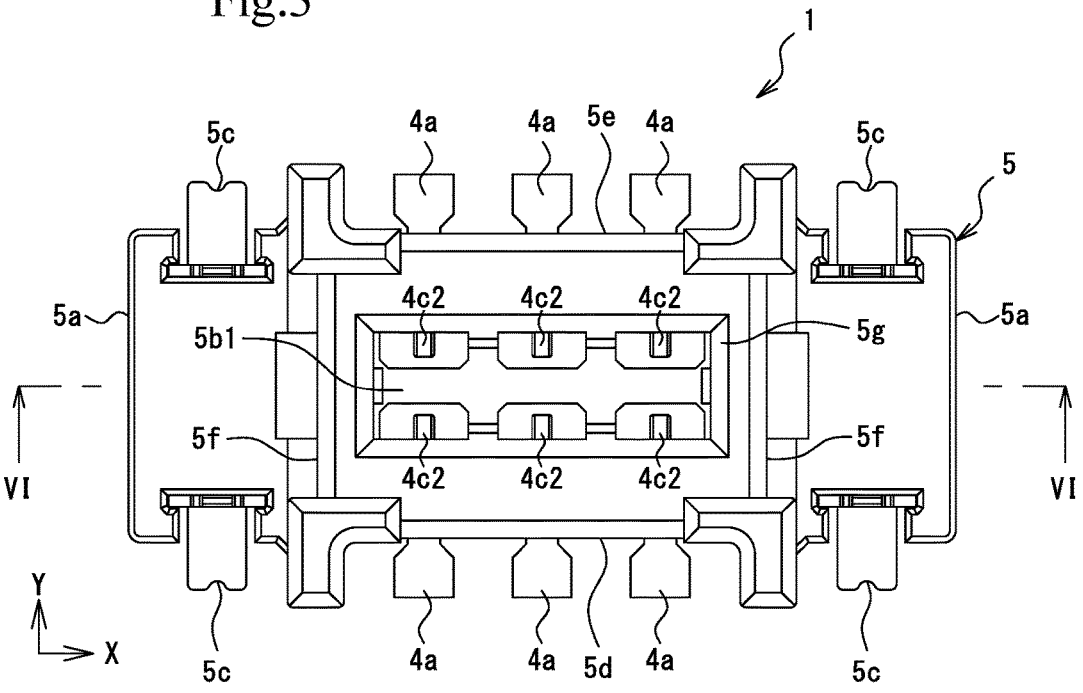
FIG. 3 is a plan view of the socket connector in FIG. 1.

Hereinafter, a preferable exemplary embodiment of a connector of the present disclosure will be described with reference to the drawings. In the present exemplary embodiment, a socket connector 1 mounted on a substrate P1 is exemplified as a "connector". Furthermore, a plug connector 2 that is a floating connector mounted on a substrate P2 is exemplified as a "movable connector". Plug terminals 3 are "objects to be connected" to the socket connector 1, and socket terminals 4 are "objects to be connected" to the plug connector 2. By connecting and fitting the socket connector 1 and the plug connector 2 to each other, the socket terminals 4 and the plug terminals 3 come in conductive contact with each other, and the substrate P1 and the substrate P2 come in conductive contact with each other.

Furthermore, the present specification is described while a width direction (a longitudinal direction) of the socket connector 1 is referred to as an X direction, a front-rear direction (a short direction) of the socket connector 1 is referred to as a Y direction, and a height direction (up-down direction) of the socket connector 1 is referred to as a Z direction. Furthermore, in a state in which the socket connector 1 and the plug connector 2 are fitted and connected to each other, the socket connector 1 side in the height direction Z is referred to as a "lower side", and the plug connector 2 side is referred to as an "upper side". However, the above does not limit the mounting method and the use method of the socket connector 1 and the plug connector 2.

Exemplary Embodiment [FIGS. 1 to 24]

Socket Connector

As illustrated in FIGS. 1 to 10, the socket connector 1 includes a socket housing 5 and the socket terminals 4.

Socket Housing

The socket housing 5 is a molded body formed of insulating resin and includes leg portions 5*a* and a fitting portion 5*b*.

The leg portions 5*a* each have a substantially rectangular parallelepiped shape and are formed at the lower ends of the socket housing 5 in the width direction X. A fixing metal fitting 5*c* is fixed to each of the ends of the leg portions 5*a* in the front-rear direction Y. The socket housing 5 is soldered to the substrate P1 with the fixing metal fittings 5*c* interposed therebetween.

The fitting portion 5*b* is formed in a box shape serving as a housing main body portion positioned between the two leg portions 5*a*. The fitting portion 5*b* includes a fitting chamber 5*b*1 and terminal accommodating portions 5*b*2. The fitting portion 5*b* includes a front wall portion 5*d* and a rear wall portion 5*e* provided in the width direction X, and side wall portions 5*f* and 5*f* that are provided in the front-rear direction Y and that connect the front wall portion 5*d* and the rear wall portion 5*e* to each other.

The fitting chamber 5*b*1 is formed by being surrounded by the front wall portion 5*d*, the rear wall portion 5*e*, and the side wall portions 5*f* and 5*f*, and a fitting hole 5*g* into which the plug connector 2 is inserted is provided on the upper end thereof. Openings 5*i* that communicate the fitting chamber 5*b*1 and the terminal accommodating portions 5*b*2 to each other are provided in inner walls 5*h* that, in the front wall portion 5*d* and the rear wall portion 5*e*, form the fitting chamber 5*b*1.

A single socket terminal 4 is accommodated inside each terminal accommodating portion 5*b*2. The socket connector 1 of the present exemplary embodiment includes six socket terminals 4 and is provided with six terminal accommodating portions 5*b*2. Three terminal accommodating portions 5*b*2 are provided in each of the front wall portion 5*d* and the rear wall portion 5*e*. The three terminal accommodating portions 5*b*2 are arranged in the width direction X. The terminal accommodating portions 5*b*2 are each formed as a recess in which the width extends in the X direction, the depth extends in the Y direction, and the height extends in the Z direction. In other words, the terminal accommodating portions 5*b*2 each include a rear surface 5*b*3 serving as a bottom of the recess, a pair of lateral surfaces 5*b*4 extending in the Y direction towards the fitting chamber 5*b*1 from two end portions of the rear surface 5*b*3 in the longitudinal direction, and a top surface 5*b*5 that closes the upper end portions of the rear surface 5*b*3 and the lateral surfaces 5*b*4.

Terminal insertion holes 5b6 for inserting the socket terminals 4 from a bottom surface side of the socket housing 5 into the terminal accommodating portions 5b2 are formed in lower portions of the terminal accommodating portions 5b2. The terminal insertion holes 5b6 are formed in a front side and a rear side in the front-rear direction Y with a center partition wall 5b7 that extends in the width direction X on a bottom surface of the socket housing 5.

Displacement restriction walls 5b8 that partition the terminal accommodating portions 5b2 with respect to the fitting chamber 5b1 are provided in the lateral surfaces 5b4 of the terminal accommodating portions 5b2. The openings 5i described above are each formed between a pair of displacement restriction walls 5b8. A first contact portion 4c2 and a second contact portion 4d2 of each socket terminal 4 accommodated in the corresponding terminal accommodating portion 5b2 protrudes from the corresponding opening 5i towards the fitting chamber 5b1.

Furthermore, terminal fixing grooves 5b9 of the socket terminal 4 are formed in the two end portions of the rear surface 5b3 of each terminal accommodating portion 5b2. During assembling of the socket connector 1, the socket terminal 4 is inserted into the terminal accommodating portion 5b2 through the terminal insertion hole 5b6 at the bottom surface of the socket housing 5 and is press-fitted and fixed to the terminal fixing grooves 5b9.

Socket Terminal

The socket terminal 4 is formed by bending a metal piece provided by punching a metal plate.

As illustrated in FIGS. 4 to 10, the socket terminal 4 includes a substrate fixed portion 4a, a base portion 4b, a first terminal piece 4c, and a second terminal piece 4d.

The substrate fixed portion 4a is provided at the lower end of the socket terminal 4 and is soldered to the substrate P1 while in contact thereto; accordingly, the socket terminal 4 is fixed to the substrate P1.

The base portion 4b is substantially rectangular, and the surface thereof is a flat plate surface. A lock protrusion 4b1 is provided in the two edges of the base portion 4b in the width direction X. The socket terminal 4 can be fixed by press-fitting the lock protrusions 4b1 into the terminal fixing grooves 5b9 such that the lock protrusions 4b1 bite the terminal fixing grooves 5b9 when the socket terminal 4 is inserted into the terminal accommodating portion 5b2 of the socket housing 5. A base end portion of a first elastic piece portion 4c1 and base end portions of a second elastic piece portion 4d1 are formed continuously from the base portion 4b. Spring length and contact pressures of the first terminal piece 4c and the second terminal piece 4d can be adjusted and can be made different from each other by extending the first elastic piece portion 4c1 and the second elastic piece portion 4d1 at different positions in the base portion 4b.

First Terminal Piece

The first terminal piece 4c is a metal piece having a bent shape that is bent in a plate thickness direction, and includes the first elastic piece portion 4c1 and the first contact portion 4c2.

The first elastic piece portion 4c1 includes, in order from the base portion 4b side, a first spring piece portion 4c3 and a first bent-back portion 4c4. The first elastic piece portion 4c1 is arranged at substantially the middle of the upper end of the base portion 4b in the width direction X, and in substantially the middle of two spring portions 4d3 and 4d3 of the second terminal piece 4d described later. With the above, the range in which the first elastic piece portion 4c1 can elastically deform in a direction in which the two spring portions 4d3 are arranged can be limited to the area in which the first elastic piece portion 4c1 is interposed between the two spring portions 4d3.

Figure 10:
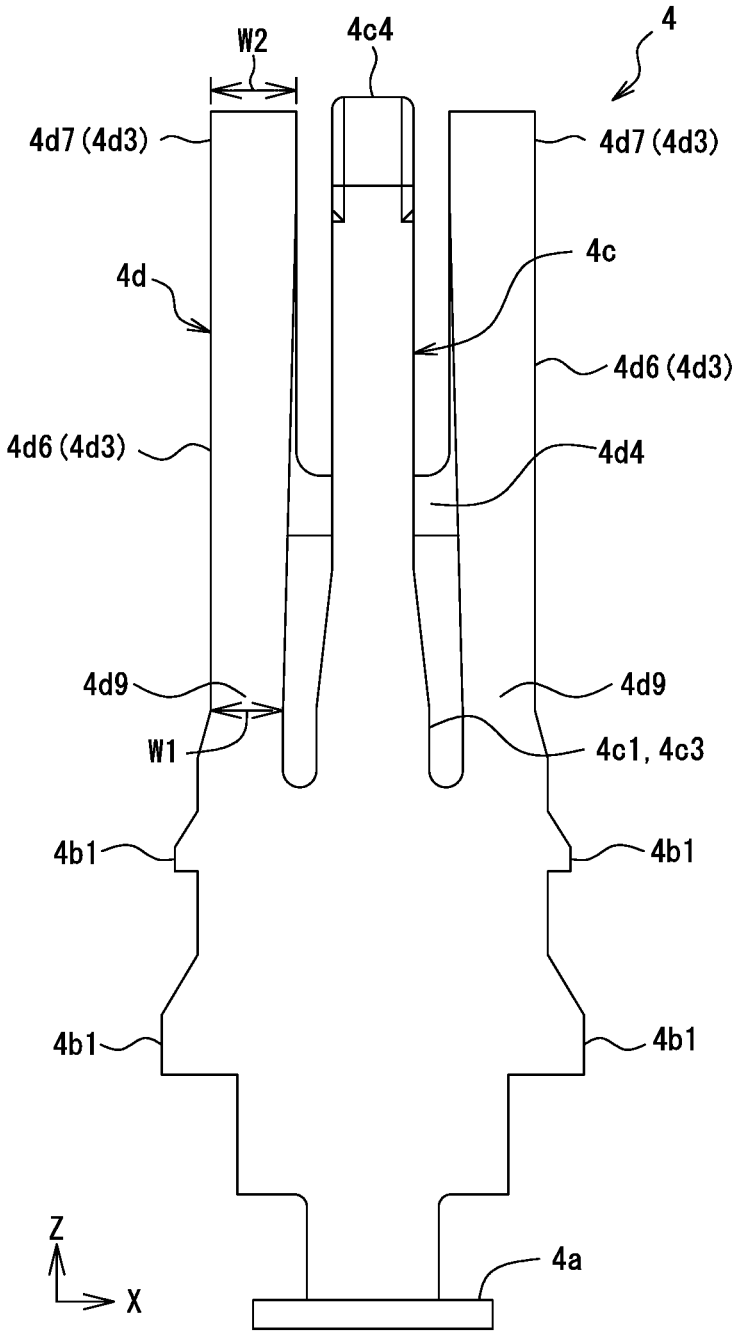
FIG. 10 is a rear view of the socket terminal in FIG. 7.
Figure 11:
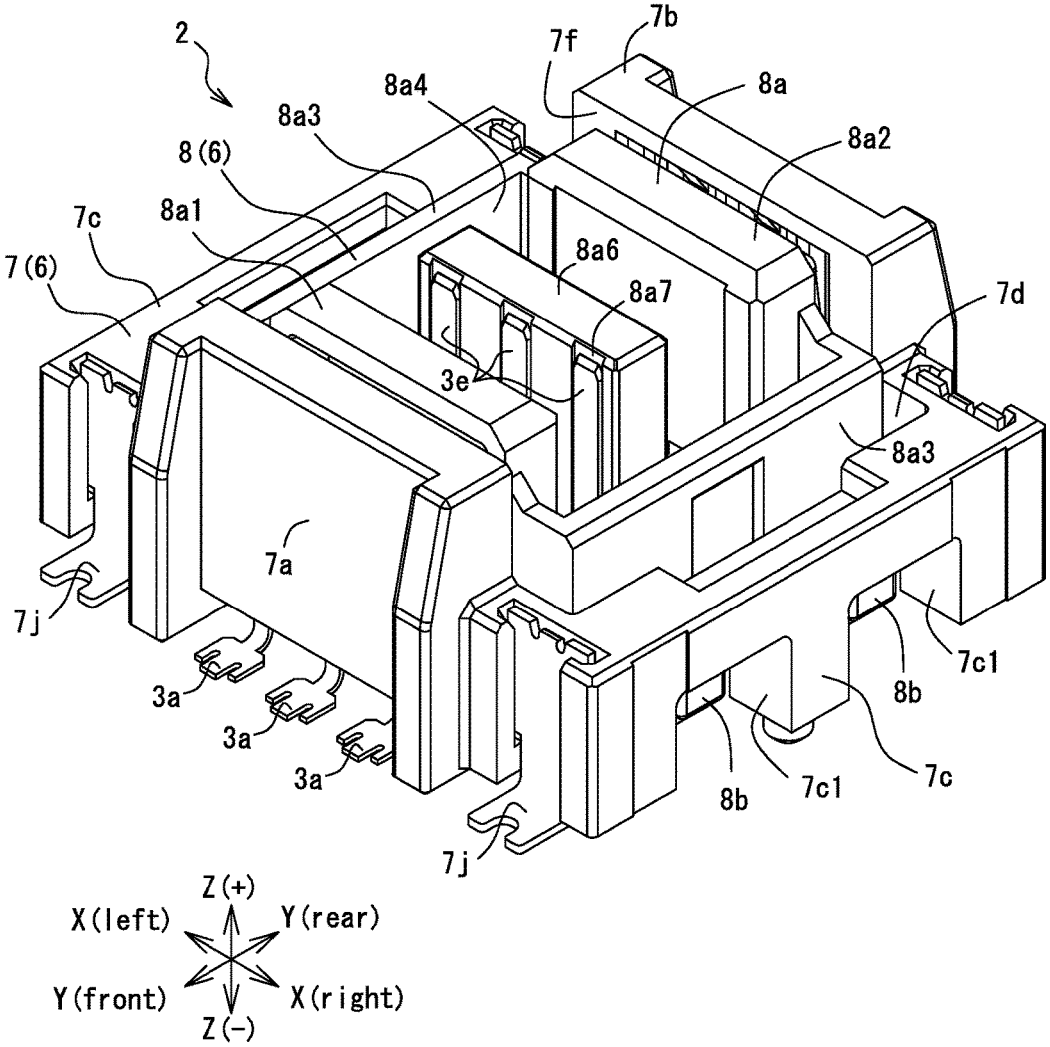
FIG. 11 is an external perspective view illustrating the front side, the right side, and the top side of a plug connector according to an exemplary embodiment.
Figure 12:
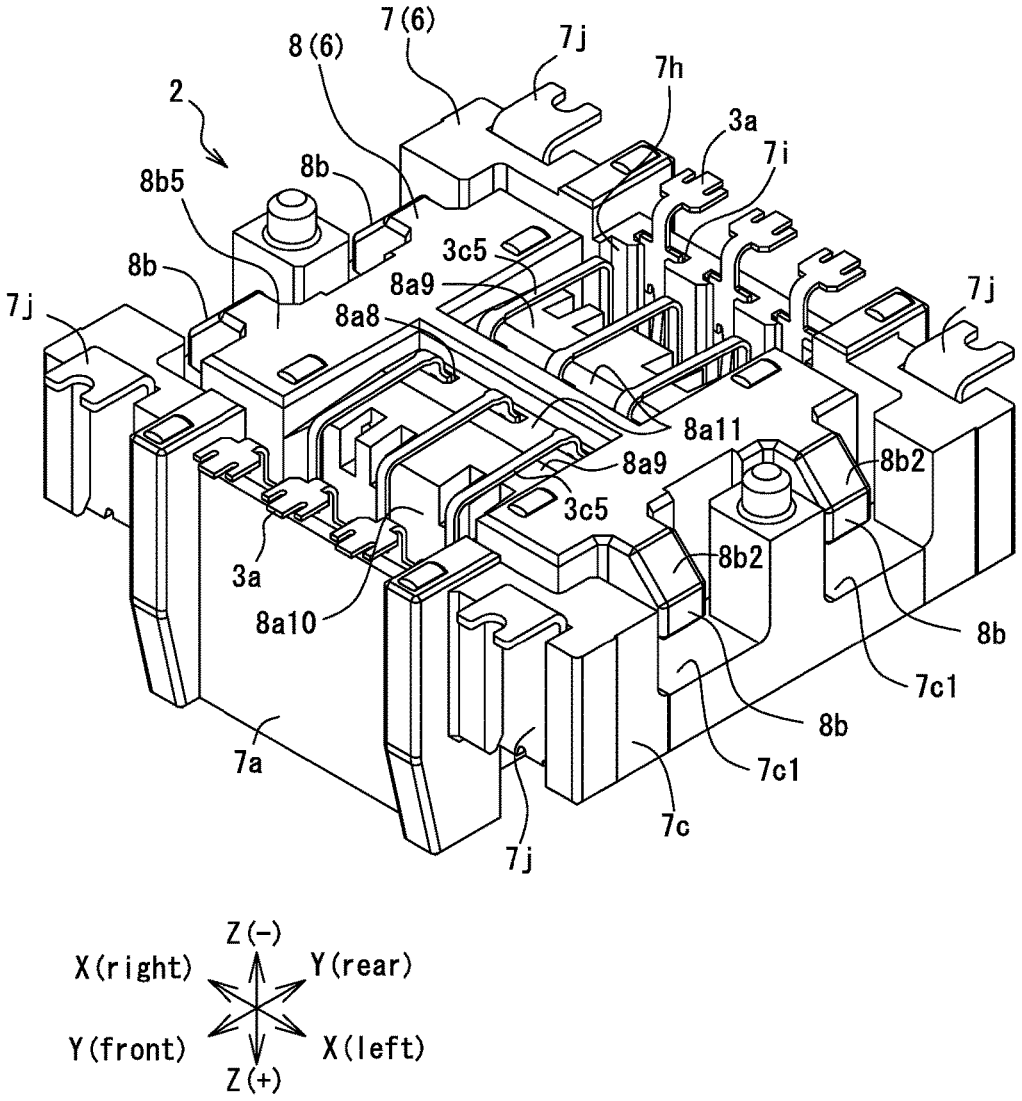
FIG. 12 is an external perspective view illustrating the front side, the left side, and the bottom side of the plug connector in FIG. 11.
Figure 13:
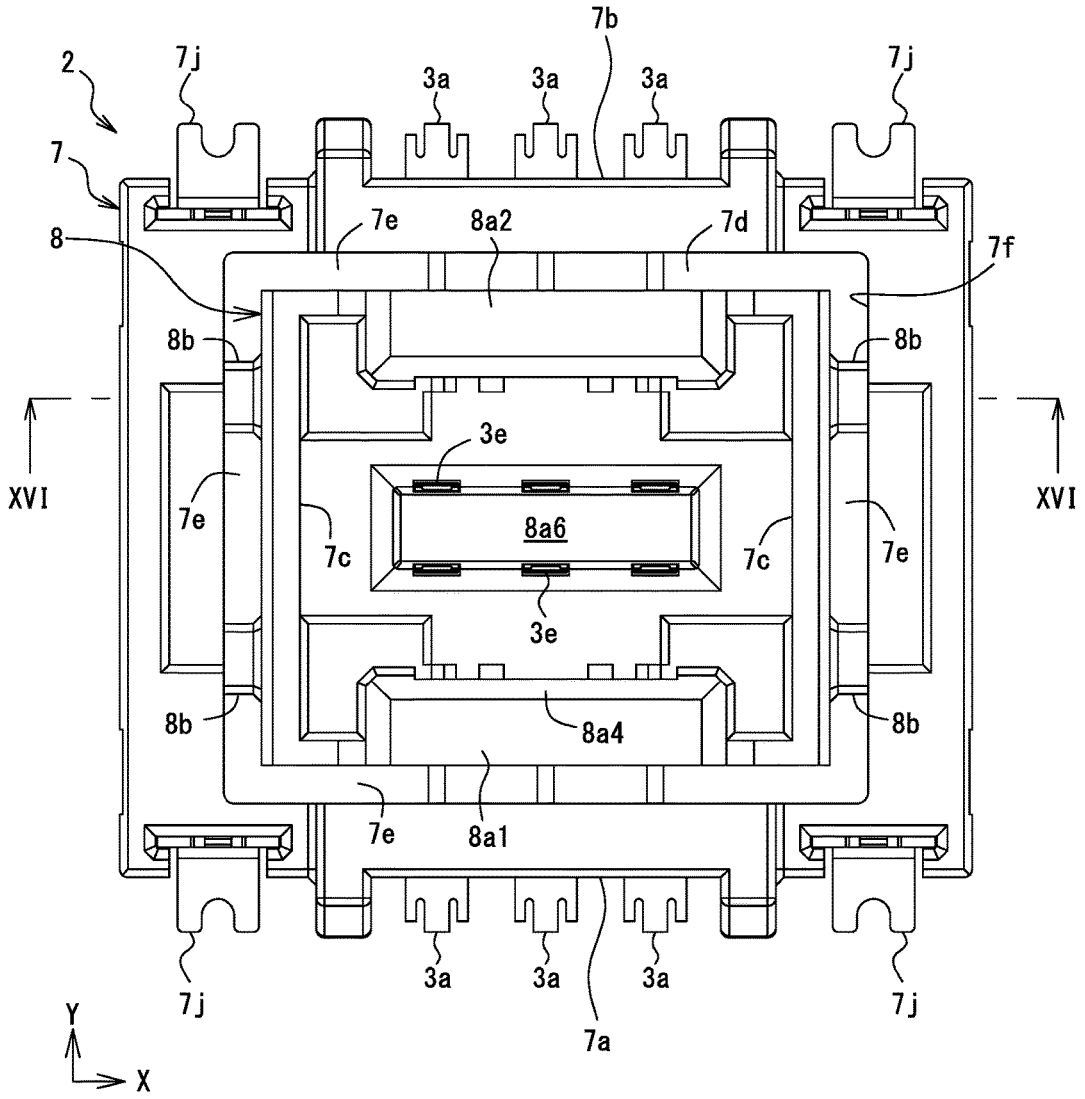
FIG. 13 is a plan view of the plug connector in FIG. 11.
Figure 14:
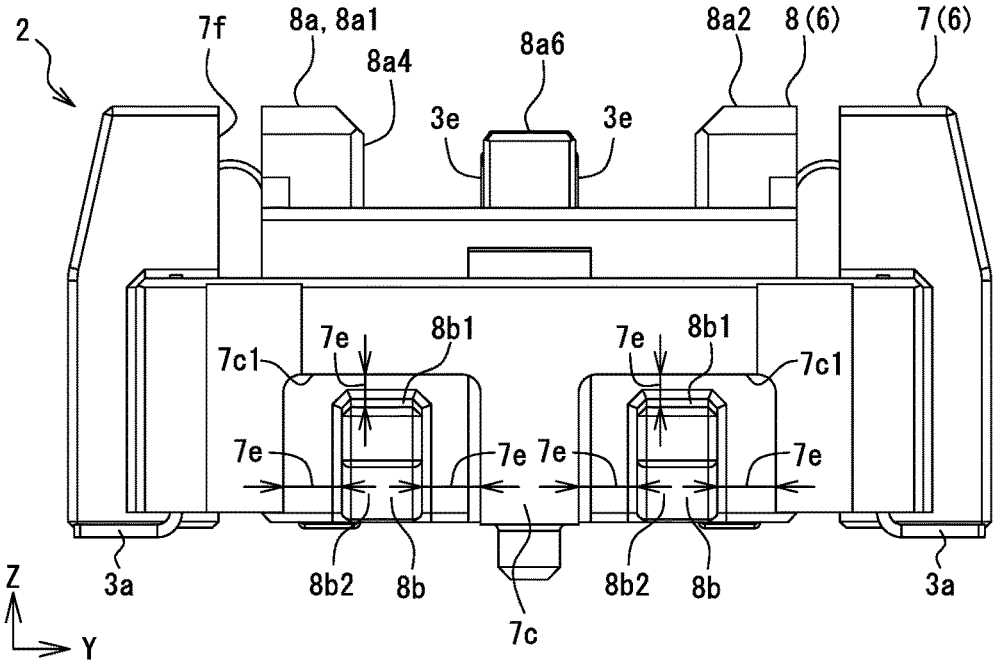
FIG. 14 is a right side view of the plug connector in FIG. 11.
Figure 15:
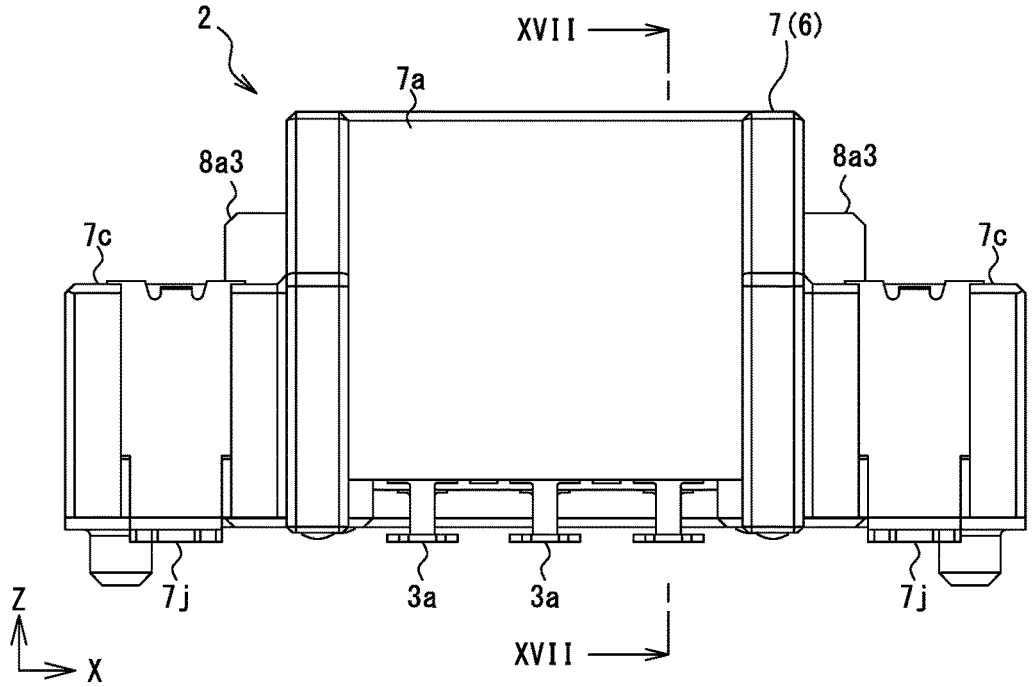
FIG. 15 is a front view of the plug connector in FIG. 11.
Figure 16:
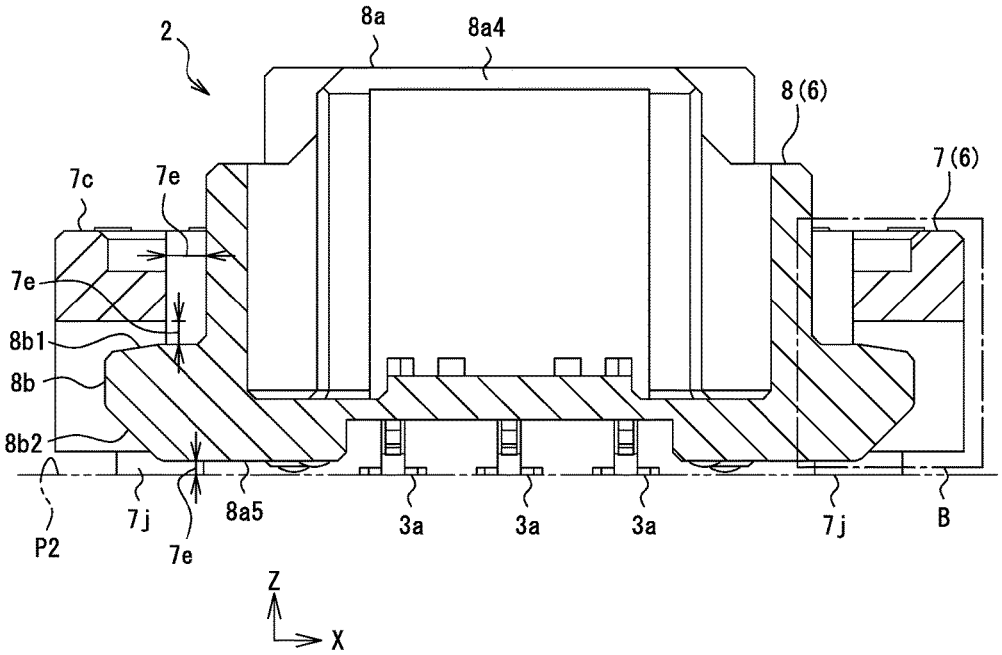
FIG. 16 is a cross-sectional view taken along line XVI-XVI in FIG. 13.

A base end of the first spring piece portion 4c3 is connected to the base portion 4b, and the first spring piece portion 4c3 is formed so as to extend in a cantilevered manner in a "first direction" that is a direction (a height direction Z(+)) in which the plug connector 2 is unplugged from the fitting chamber 5b1. The first spring piece portion 4c3 is bent at a bend portion 4c8 at a base end side of the first spring piece portion 4c3 arranged inside the terminal accommodating portion 5b2 and along the rear surface 5b3, and extends in the height direction Z from the bend portion 4c8 to a distal end side of the first spring piece portion 4c3 while inclining obliquely towards the opening 5i of the socket housing 5. Furthermore, as illustrated in FIG. 10, the first spring piece portion 4c3 is formed such that a plate width on the base end side connected to the base portion 4b is wider than a plate width on the distal end side connected to the first bent-back portion 4c4. With the above, the first terminal piece 4c is configured so that the spring is hard (so that the contact pressure is high).

The first bent-back portion 4c4 is formed from an upper end of the first spring piece portion 4c3 so as to be bent in a "second direction" that is a direction that is opposite to the first direction and that is a direction (a height direction Z(−)) in which the plug connector 2 is inserted into the fitting chamber 5b1. If one were to obtain a sufficient spring length without such a first bent-back portion 4c4 by extending the first spring piece portion 4c3 in the first direction Z(+), the socket terminal 4 becomes large in the height direction Z. However, in the present exemplary embodiment, the socket terminal 4 is bent in the second direction Z(−) at the first bent-back portion 4c4 and the first contact portion 4c2 is formed from there on; accordingly, while obtaining a sufficient spring length of the first terminal piece 4c, the socket terminal 4 can be reduced in size in the height direction Z.

The first contact portion 4c2 includes a front contact guide portion 4c5, a front contact portion 4c6, and a distal end portion 4c7.

Figure 4:
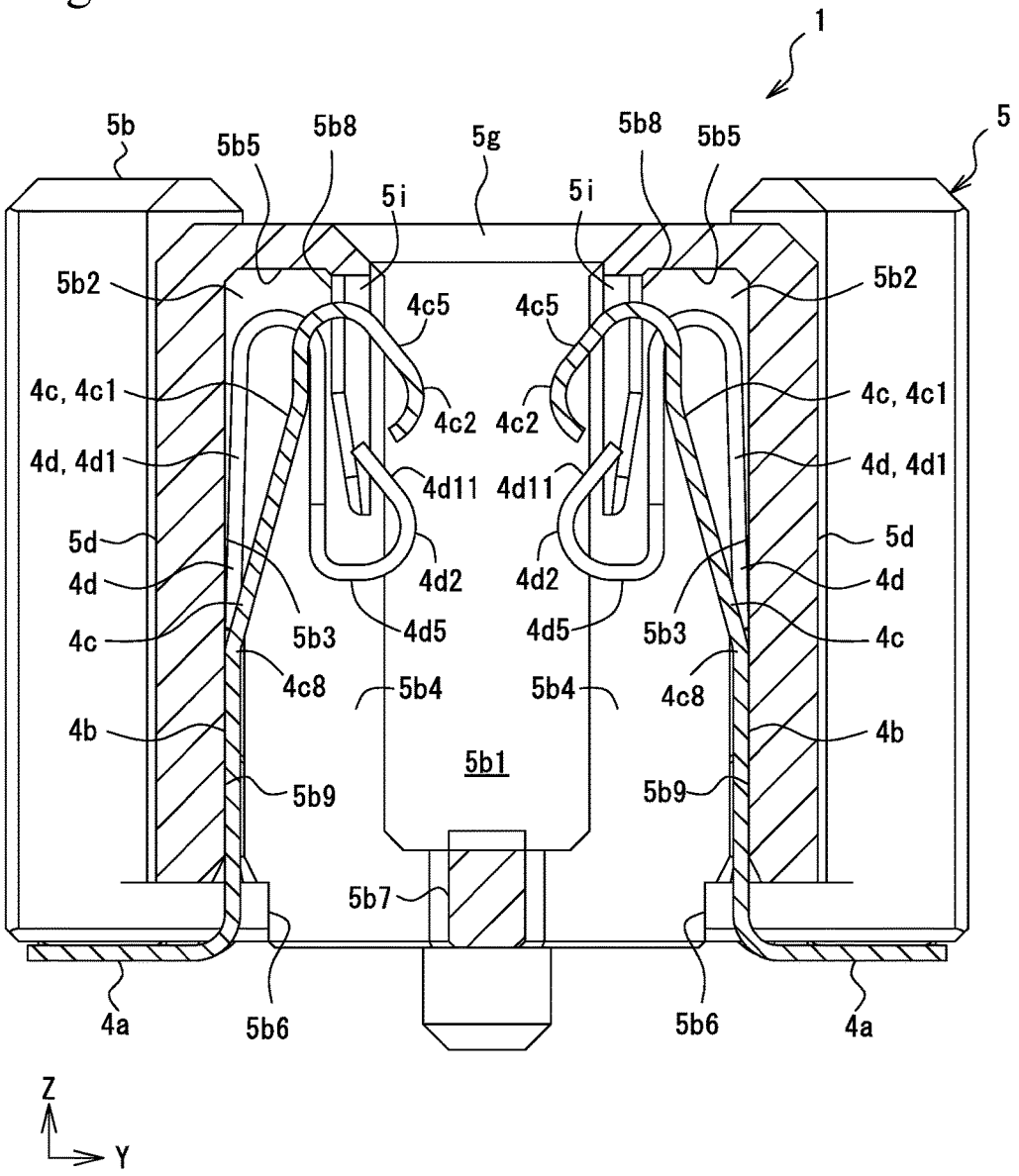
FIG. 4 is a cross-sectional view taken along line IV-IV in FIG. 2.
Figure 5:
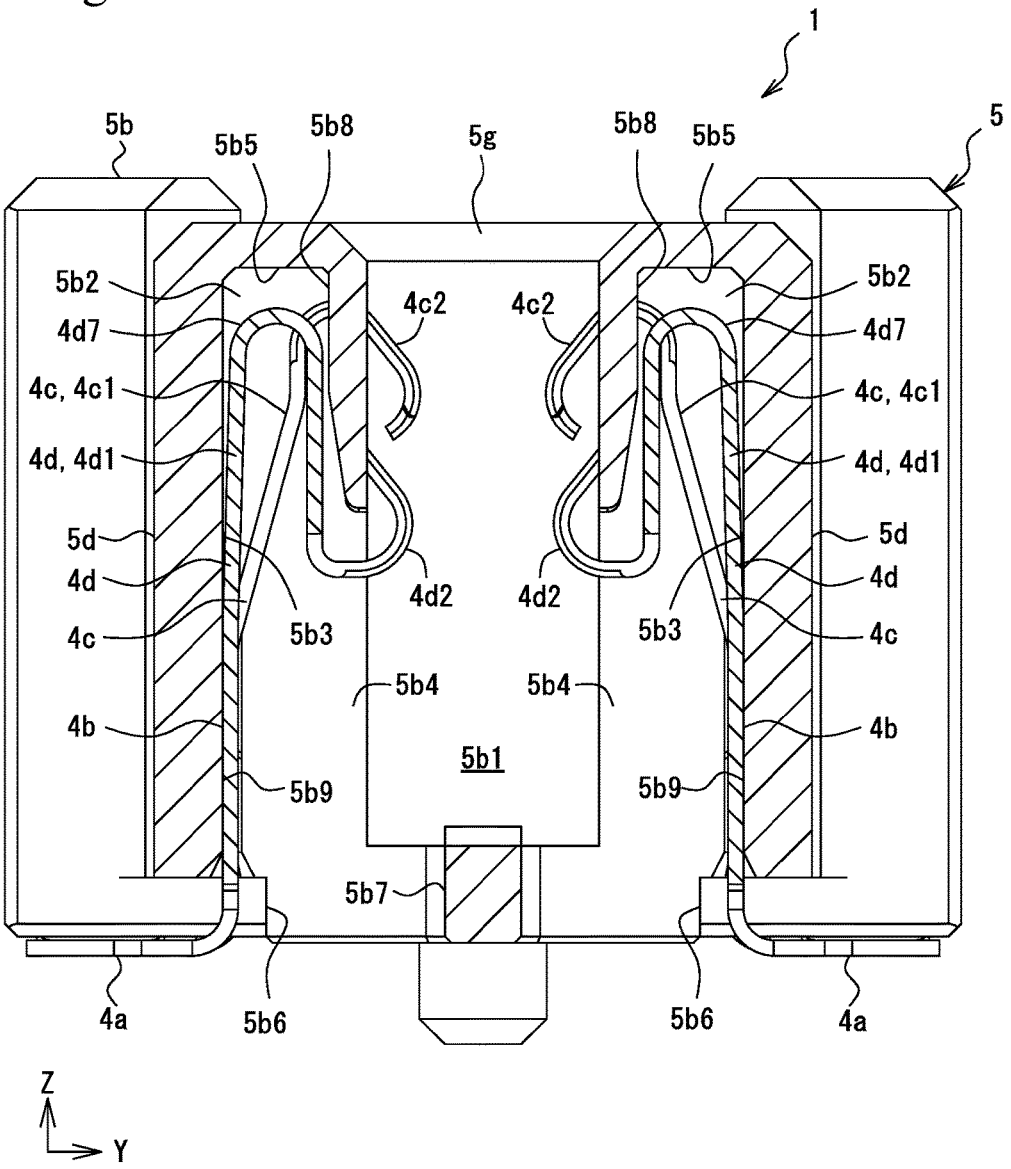
FIG. 5 is a cross-sectional view taken along line V-V in FIG. 2.
Figure 6:
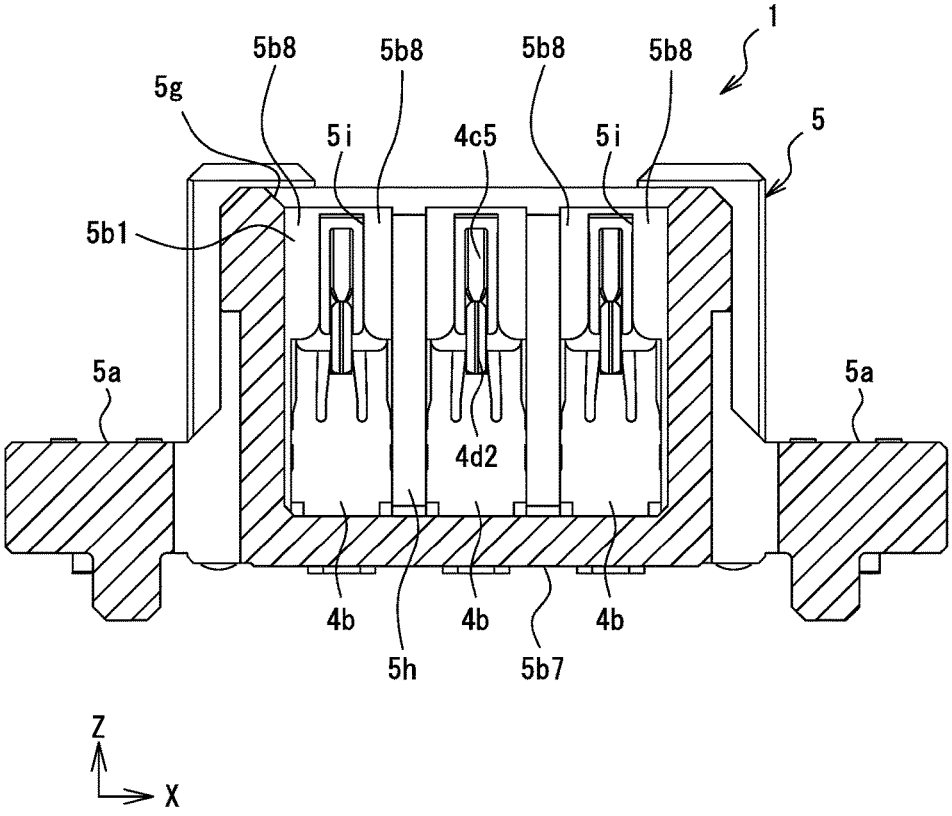
FIG. 6 is a cross-sectional view taken along line VI-VI in FIG. 3.
Figure 7:
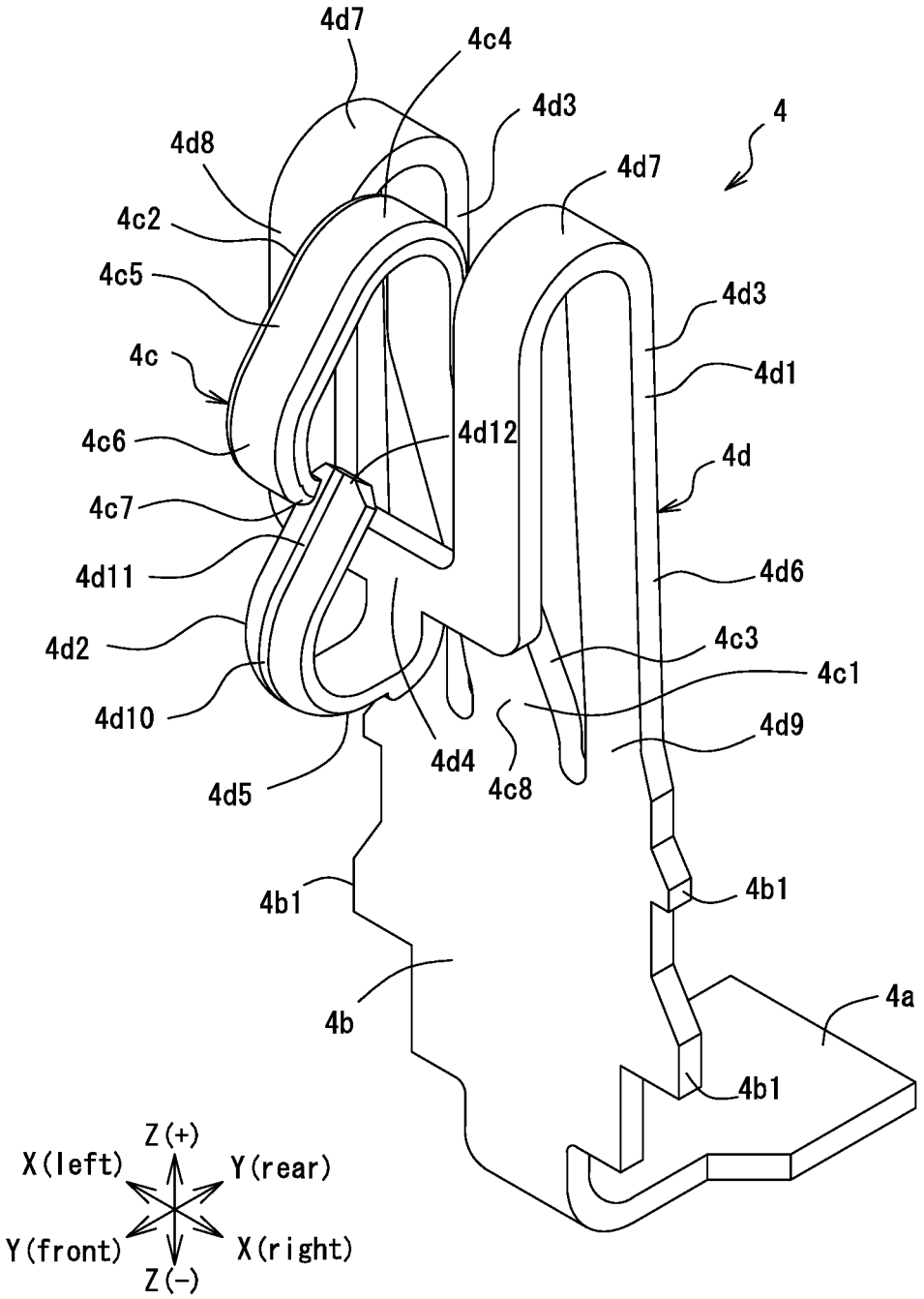
FIG. 7 is an external perspective view illustrating the front side, the right side, and the top side of a socket terminal in FIG. 1.

As illustrated in FIG. 4, the front contact guide portion 4c5 protrudes into the fitting chamber 5b1 through the opening 5i of the socket housing 5, and is an area in the socket terminal 4 where the plug terminal 3 inserted through the fitting hole 5g comes in contact first. The front contact guide portion 4c5 is positioned on a "front side" with respect to the inserted plug terminal 3, and a rear contact guide portion 4d11 described later is positioned on a "rear side". The front contact guide portion 4c5 pressed and contacted by the plug terminal 3 slides against and comes in contact with the plug terminal 3 while receiving the plug terminal 3 on the flat contact surface thereof in a smooth manner, and is displaced towards the terminal accommodating portion 5b2. The first bent-back portion 4c4 does not protrude into the fitting chamber 5b1 and is positioned inside the terminal accommodating portions 5b2 at all times; accordingly, there is no concern of the plug connector 2 abutting against the first bent-back portion 4c4 and the socket terminal 4 becoming buckled.

The front contact portion 4c6 is formed so as to be curved in a mountain shape in the plate thickness direction of the metal plate. The front contact portion 4c6 is arranged in substantially the middle of the socket terminal 4 in the width direction X. The contact surface of the front contact portion 4c6 is provided as a roll face that is the first terminal piece 4c bent in the plate thickness direction. Normally, there is a fine unevenness in the cutout surface (the plate thickness surface) of the punched terminal created in the punching process, and in a case in which the portion in contact with the mating terminal is, for example, formed as a cutout surface of the punched terminal, there is a concern that the contact surface of the mating terminal may become damaged. Conversely, since the front contact portion 4c6 is a roll face, the plug terminal 3 is not easily damaged even if insertion and removal are repeated between the connectors, and the plug terminal 3 undergoes repeated sliding and contact.

The distal end portion 4c7 is formed at an end portion of the front contact portion 4c6 on the distal end side. The distal end portion 4c7 will be further described later.

Second Terminal Piece

The second terminal piece 4d is a metal piece having a bent shape that is bent in a plate thickness direction, and includes the second elastic piece portion 4d1 and the second contact portion 4d2.

The second elastic piece portion 4d1 includes two spring portions 4d3, a joining portion 4d4, and a third bent-back portion 4d5.

Each spring portion 4d3 includes, in order from the base portion 4b side, a base end spring piece 4d6, a second bent-back portion 4d7, and an intermediate spring piece 4d8, which are formed symmetrically in the width direction X. The spring portion 4d3 is connected to an end portion of the base portion 4b that is an upper end in the width direction X and is formed so as to extend in a cantilevered manner in the "first direction" that is the direction (the height direction Z(+)) in which the plug connector 2 is unplugged from the fitting chamber 5b1.

The base end spring piece 4d6 extends inside the terminal accommodating portion 5b2 in a linear manner towards the top surface 5b5 along the rear surface 5b3. As illustrated in FIG. 10, each base end spring piece 4d6 is shaped so that the width becomes larger from the base end side connected to the base portion 4b towards the distal end side connected to the second bent-back portion 4d7. In the present exemplary embodiment, narrow width portions 4d9 that each have a plate width narrower than a plate width W2 on the distal end side connected to the second bent-back portion 4d7 are formed on the base end side that is a side opposite to the second bent-back portion 4d7. The area of each base end spring piece 4d6 on the base end side has the narrowest plate width W1. Each base end spring piece 4d6 having such a narrow width portion 4d9 is configured in such a manner that the spring becomes soft and elastic deformation is facilitated. Furthermore, while the first terminal piece 4c is formed so that the plate width of the first spring piece portion 4c3 on the base end side is large, each narrow width portion 4d9 is formed so that the plate width is narrow by forming the area of the plate edge adjacent to the first terminal piece 4c in an oblique manner from the distal end side connected to the second bent-back portion 4d7 towards the base end side. Accordingly, compared with a case in which the plate edge not adjacent to the first terminal piece 4c is formed in an oblique manner, the width of the socket terminal 4 in the width direction X where the first terminal piece 4c and the second terminal piece 4d are connected to each other can be reduced.

Each second bent-back portion 4d7 is formed from an upper end of base end spring piece 4d6 in an inverted U-shape that is bent in the "second direction" that is the direction that is opposite to the first direction and that is the direction (the height direction Z(−)) in which the plug connector 2 is inserted into the fitting chamber 5b1. The second bent-back portion 4d7 is formed at a position overlapping the first bent-back portion 4c4 in the width direction X. With the above, the height of the socket terminal 4 is lowered without the second terminal piece 4d protruding in the height direction Z with respect to the first terminal piece 4c.

Each intermediate spring piece 4d8 extends parallel to the base end spring piece 4d6 from the corresponding second bent-back portion 4d7 in the second direction Z(−). Each intermediate spring piece 4d8 is formed so that the length thereof exceeds the length of the first contact portion 4c2 of the first terminal piece 4c. Owing to the base end spring pieces 4d6, the second bent-back portions 4d7, and the intermediate spring pieces 4d8, the second terminal piece 4d configured in the above manner is capable of obtaining a long spring length even in the small inner space of the terminal accommodating portion 5b2.

The joining portion 4d4 is a portion that connects the distal ends of the two spring portions 4d3 (the distal ends of the intermediate spring pieces 4d8) in the width direction X. The joining portion 4d4 is accommodated inside the terminal accommodating portion 5b2 and is formed at a position overlapping the displacement restriction wall 5b8 in the front-rear direction Y. Accordingly, even if the joining portion 4d4 is about to protrude into the fitting chamber 5b1 from the terminal accommodating portion 5b2, the joining portion 4d4 is blocked by the displacement restriction wall 5b8; accordingly, no trouble, such as the joining portion 4d4 coming in contact with the inserted plug terminal 3, will occur. Furthermore, since the distal ends of the two spring portions 4d3 are connected to the joining portion 4d4, the spring elastic force of the two spring portions 4d3 can be exerted as contact force of a rear contact portion 4d10 against the plug terminal 3. Furthermore, even in a case in which a load is applied to the second elastic piece portion 4d1 in the direction in which the spring portions 4d3 are arranged, since the spring portions 4d3 fix the second elastic piece portion 4d1 to the base portion 4b, a deformation to the extent causing plastic deformation does not easily occur.

The third bent-back portion 4d5 is formed in a protruding manner so as to be bent in the first direction Z(+) from the joining portion 4d4. The third bent-back portion 4d5 is formed at a position in the middle of the joining portion 4d4 in the width direction X. With the above, as illustrated in FIG. 8, the first contact portion 4c2 and the second contact portion 4d2 are arranged on a straight line extending in the height direction Z.

The second contact portion 4d2 includes the rear contact portion 4d10, the rear contact guide portion 4d11, and a distal end portion 4d12.

The rear contact portion 4d10 is formed so as to be curved in a mountain shape in the plate thickness direction of the metal plate. The rear contact portion 4d10 is arranged in substantially the middle of the socket terminal 4 in the width direction X. The contact surface of the rear contact portion 4d10 is provided as a roll face that is the second terminal piece 4d bent in the plate thickness direction. With the above, similar to the front contact portion 4c6 of the first terminal piece 4c, the plug terminal 3 is not easily damaged even when sliding and contact is repeated.

Figure 8:
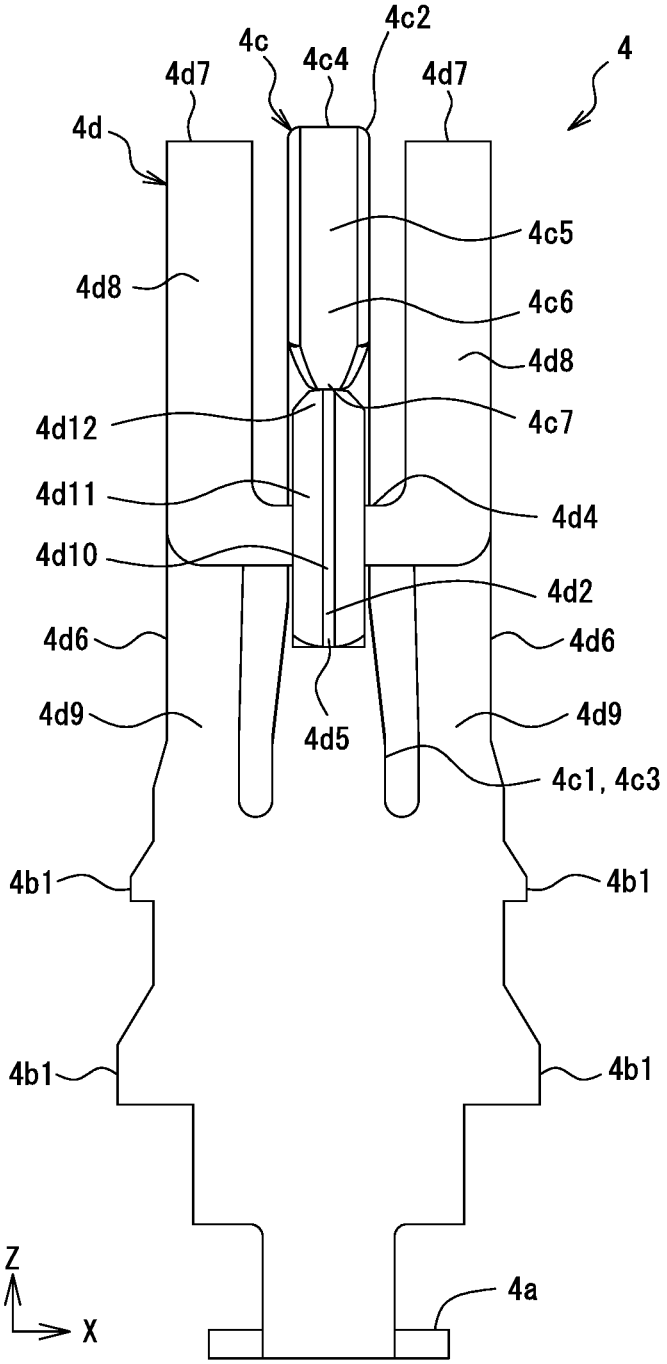
FIG. 8 is a front view of the socket terminal in FIG. 7.

Furthermore, the rear contact portion 4d10 is arranged on the same straight line extending along the front contact portion 4c6 and in an insertion direction of the plug connector 2 (FIG. 8). Accordingly, each plug terminal 3 of the plug connector 2 comes in contact in the order of the front contact portion 4c6 and the rear contact portion 4d10. In so doing, the front contact portion 4c6 can remove the foreign substance adhered on the plug terminal 3, and the rear contact portion 4*d*10 can come in contact with the plug terminal 3 from which the foreign substance has been removed; accordingly, connection reliability can be increased.

Moreover, by arranging the front contact portion 4*c*6 and the rear contact portion 4*d*10 at positions different from each other in the insertion direction Z of the plug terminal 3, the insertion force can be dispersed so that the load to the hand of the operator through the contact portions is not all applied at the same time when inserting the plug terminals 3. Accordingly, insertion of the plug terminal 3 is facilitated for the operator.

As illustrated in FIG. 4, the rear contact guide portion 4*d*11 obliquely extends into the opening 5*i* from an end portion of the third bent-back portion 4*d*5 positioned in the fitting chamber 5*b*1 of the socket housing 5, and is an area in the second terminal piece 4*d* where the plug terminal 3 inserted through the fitting hole 5*g* comes in contact first. The rear contact guide portion 4*d*11 pressed and contacted by the plug terminal 3 slides against and comes in contact with the plug terminal 3 while receiving the plug terminal 3 on the flat contact surface thereof in a smooth manner, and is displaced towards the terminal accommodating portion 5*b*2. The rear contact guide portion 4*d*11 is formed with a length that reaches the extended line of the distal end portion 4*c*7 of the first terminal piece 4*c*.

The distal end portion 4*d*12 is formed at an end portion of the rear contact guide portion 4*d*11. As illustrated in FIG. 4, the distal end portion 4*d*12 not extending into the fitting chamber 5*b*1 is positioned inside the opening 5*i* (inside the thickness of the displacement restriction wall 5*b*8). Accordingly, the plug terminal 3 inserted in the fitting chamber 5*b*1 is not caught by the distal end portion 4*d*12. However, according to the terminal structure of the present embodiment, the inserted plug terminal 3 does not become caught by the distal end portion 4*d*12 even in a case in which there is no displacement restriction wall 5*b*8, due to the following reason. Regarding the positional relationship between the distal end portion 4*c*7 of the first terminal piece 4*c* and the distal end portion 4*d*12 of the second terminal piece 4*d*, the distal end portion 4*d*12 is positioned in an area between the distal end portion 4*c*7 and the first spring piece portion 4*c*3 in the front-rear direction Y. Accordingly, the distal end portion 4*d*12 of the second terminal piece 4*d* is hidden in the insertion direction Z(−) of the plug connector 2 from the inserted plug terminal 3 with the first contact portion 4*c*2 of the first terminal piece 4*c*, such that buckling of the second terminal piece 4*d* caused by the plug terminal 3 abutting against the distal end portion 4*d*12 does not occur. Furthermore, as described above, by forming the socket terminal 4 so that the distal end portion 4*d*12 is positioned between the distal end portion 4*c*7 and the first spring piece portion 4*c*3 in the front-rear direction Y, the first contact portion 4*c*2 and the second contact portion 4*d*2 can be arranged close to each other and, as a result, the rear contact portion 4*d*10 can be positioned close to the front contact portion 4*c*6 in the height direction Z. With the above, in a state in which the connectors are fitted and connected to each other, the effective fitting length of the rear contact portion 4*d*10 with respect to the plug terminal 3 can be increased, and the connection reliability can be increased. Furthermore, by arranging the second contact portion 4*d*2 close to the first contact portion 4*c*2, the size of the socket terminal 4 in the height direction Z can be reduced, and the terminal accommodating portion 5*b*2 can also be formed in a compact manner in the height direction Z as well.

Plug Connector

The plug connector 2 is a floating connector including a plug housing 6 and the plug terminals 3.

Plug Housing

As illustrated in FIGS. 11 to 14, the plug housing 6 includes fixed housing 7 and a movable housing 8.

Fixed Housing

The fixed housing 7 is a molded body formed of insulating resin, and includes fixing metal fittings 7*j* to solder the fixed housing 7 to the substrate P2. The fixed housing 7 is formed in a box shape that includes a front wall portion 7*a*, a rear wall portion 7*b*, and side wall portions 7*c* and 7*c*. An accommodation portion 7*d* that accommodates the movable housing 8 is formed inside the fixed housing 7, and movable spaces 7*e* are formed between the fixed housing 7 and the movable housing 8. An upper surface opening 7*f* is formed in an upper surface of the fixed housing 7, and a bottom surface opening 7*g* is formed in a bottom surface. Accordingly, the movable housing 8 is exposed to the outside through the upper surface opening 7*f* and the bottom surface opening 7*g*.

The front wall portion 7*a* and the rear wall portion 7*b* each include three terminal accommodating portions 7*h* each in which a plug terminal 3 is accommodated. The terminal accommodating portions 7*h* are provided as recesses formed in the inner surfaces of the front wall portion 7*a* and the rear wall portion 7*b* that oppose the accommodation portion 7*d*, and three terminal accommodating portions 7*h* are arranged in the width direction X in the front wall portion 7*a* and in the rear wall portion 7*b*. The terminal accommodating portions 7*h* are formed as spaces that allow displacement of movable pieces 3*c* of the plug terminals 3 described later. A terminal fixing portion 7*i* that fixes the plug terminal 3 is formed in each terminal accommodating portion 7*h*.

The side wall portions 7*c* are provided on both end sides in the width direction X, and connect the front wall portion 7*a* and the rear wall portion 7*b* to each other. Furthermore, two locking recesses 7*c*1 are formed in each of the side wall portion 7*c* so as to be arranged therein.

Movable Housing

The movable housing 8 is a molded body formed of insulating resin, and is disposed in the accommodation portion 7*d* of the fixed housing 7. The movable housing 8 is capable of being displaced with respect to the fixed housing 7 in the area of the movable spaces 7*e* of the fixed housing 7. The movable housing 8 includes a fitting portion 8*a* including a square frame-shaped peripheral wall, and displacement restricting protrusions 8*b*.

The fitting portion 8*a* includes a front wall portion 8*a*1 and a rear wall portion 8*a*2 that extend in the width direction X, and side wall portions 8*a*3 and 8*a*3 that are provided in the front-rear direction Y and that connect the front wall portion 8*a*1 and the rear wall portion 8*a*2 to each other. A fitting hole 8*a*4 in which the socket connector 1 is fitted is formed in an upper surface of the fitting portion 8*a*. A bottom wall portion 8*a*5 is formed in a bottom surface of the fitting portion 8*a*.

Terminal accommodating portions 8*a*10 that allow displacement of the movable pieces 3*c* of the plug terminals 3 described later are formed as recesses in outer surfaces of the front wall portion 8*a*1 and the rear wall portion 8*a*2 opposing the fixed housing 7. The terminal accommodating portions 8*a*10 are positioned so as to oppose the terminal accommodating portions 7*h* of the fixed housing 7 described above. The two members, that is, each terminal accommodating portions 7*h* and the corresponding terminal accommodating portion 8*a*10 disposed together function as a displacement space of the corresponding movable piece 3*c*.

As described later, the movable housing 8 of the present exemplary embodiment allows a large displacement amount to be obtained in case of tilting. The large displacement of the movable pieces 3*c* is allowed by the two members, that is, each terminal accommodating portions 7*h* and the corresponding terminal accommodating portion 8*a*10. Furthermore, the size of the plug housing 6 in the front-rear direction Y is reduced by forming the terminal accommodating portions 7*h* and 8*a*10 as recesses.

A middle wall 8*a*6 that protrude from the bottom wall portion 8*a*5 into the fitting portion 8*a* is formed inside the fitting portion 8*a*. Furthermore, the front wall portion 5*d*, the rear wall portion 5*e*, and the side wall portions 5*f* of the socket housing 5 are inserted between an inner peripheral surface and the middle wall 8*a*6 of the fitting portion 8*a*, and the middle wall 8*a*6 is inserted in the fitting chamber 5*b*1 of the socket housing 5.

The middle wall 8*a*6 includes plate surfaces that extend in the width direction X and the height direction Z, and a fitting recess 8*a*7 to which the plug contact portion 3*e* of the plug terminal 3 described later is attached is formed in each of the plate surfaces. Furthermore, terminal fixing holes 8*a*8 in which the plug terminals 3 are fixed and that penetrate the bottom wall portion 8*a*5 in the wall thickness direction are formed in the bottom wall portion 8*a*5.

Figure 17:
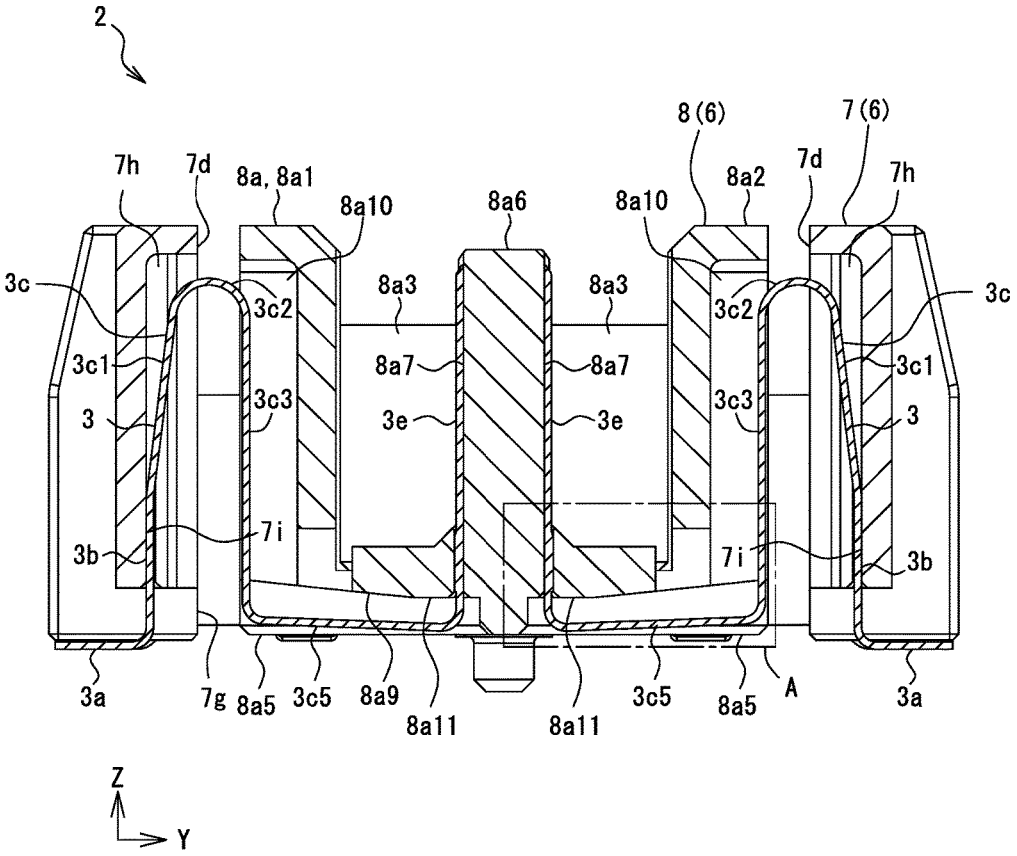
FIG. 17 is a cross-sectional view taken along line XVII-XVII in FIG. 15.
Figure 18:
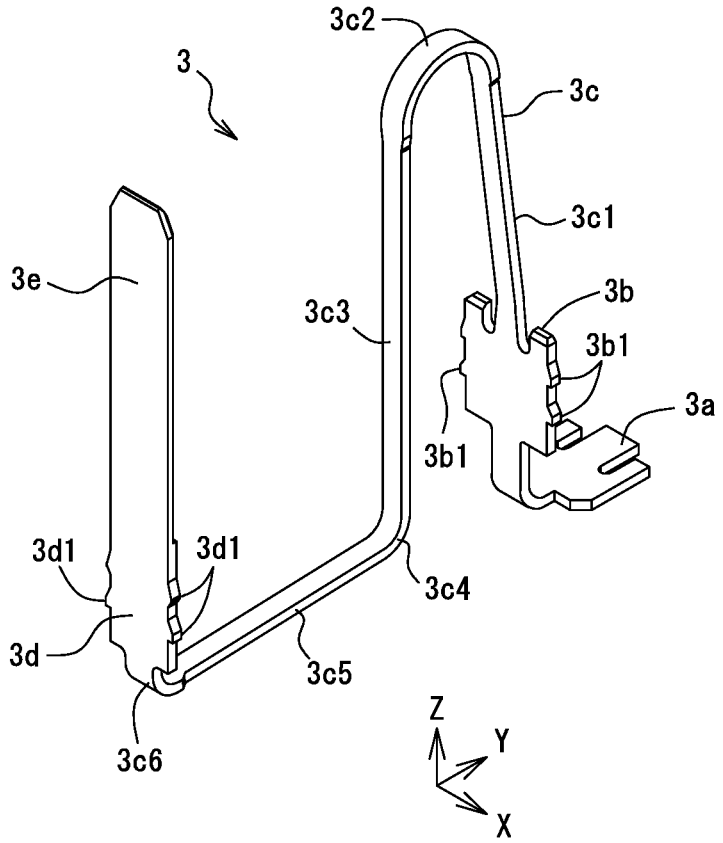
FIG. 18 is an external perspective view illustrating the front side, the right side, and the top side of the plug terminal in FIG. 11.

Inclined surface portions 8*a*9 are formed on the bottom surface (the surface opposing the substrate) of the bottom wall portion 8*a*5 from the middle side towards the outer edge side of the bottom wall portion 8*a*5. The inclined surface portions 8*a*9 are formed in an inclined manner from the middle side towards the outer edge side so that the gaps between the front surface of the substrate P2, serving as "opposing surfaces", gradually increase. The inclined surface portions 8*a*9 are formed in bottom surfaces of recesses 8*a*11 formed in the bottom wall portion 8*a*5. The recesses 8*a*11 are formed so as to be recessed in the height direction Z(+) in FIG. 12. As illustrated in FIG. 17, by accommodating inclined piece portions 3*c*5 of the movable pieces 3*c* of the plug terminals 3 described later in the recesses 8*a*11, the height of the movable housing 8 can be reduced compared to a case in which no recess 8*a*11 is provided.

The displacement restricting protrusions 8*b* are formed so as to protrude outwardly from the side wall portions 8*a*3 of the fitting portion 8*a* in the width direction X. Two displacement restricting protrusions 8*b* are provided in the front-rear direction Y in each side wall portion 8*a*3. Furthermore, the displacement restricting protrusions 8*b* are arranged inside the locking recesses 7*c*1 and 7*c*1 provided in the side wall portions 7*c* of the fixed housing 7. Furthermore, for example, in a case in which the movable housing 8 is about to become excessively displaced in the height direction Z with respect to the fixed housing 7, the excessive displacement of the movable housing 8 with respect to the fixed housing 7 is restricted by the displacement restricting protrusions 8*b* being in contact with the locking recesses 7*c*1. Furthermore, since two displacement restricting protrusions 8*b* are provided in the front-rear direction Y, compared with a case in which only one is provided, the movable housing 8 is less easily inclined with respect to the fixed housing 7 in the front-rear direction Y.

Upper portion inclined surfaces 8*b*1 each serving as a "corner edge absent portion" are provided on the upper surfaces of the displacement restricting protrusions 8*b* in the height direction Z. On the other hand, lower portion inclined surfaces 8*b*2 each serving as a "corner edge absent portion" are also provided on the bottom surfaces that are on the opposite side with respect to the upper surfaces. The upper portion inclined surfaces 8*b*1 and the lower portion inclined surfaces 8*b*2 are formed by obliquely removing the corner edges on the outer edge side of the displacement restricting protrusions 8*b* in a case in which the displacement restricting protrusions 8*b* have rectangular parallelepiped shapes. With the above, the gaps between the end portions of the displacement restricting protrusions 8*b* and the locking recesses 7*c*1 of the fixed housing 7 or the substrate P2 can be increased, and compared with a case in which no upper portion inclined surface 8*b*1 and no lower portion inclined surface 8*b*2 are provided, displacement amount of the inclination of the movable housing 8 can be increased.

Plug Terminal

Three plug terminals 3 are disposed between one surface of the middle wall 8*a*6 and the front wall portion 7*a*, and between the other surface of the middle wall 8*a*6 and the rear wall portion 7*b*. Each plug terminal 3 is formed by bending a metal plate, and includes a substrate connection 3*a*, a fixed housing fixing portion 3*b*, the movable piece 3*c*, a movable housing fixing portion 3*d*, and the plug contact portion 3*e*.

The substrate connection 3*a* has a substantially rectangular plate surface. The plug terminal 3 is soldered while the substantially rectangular plate surface is in contact with the substrate surface of the substrate P2.

The fixed housing fixing portion 3*b* is formed as a substantially rectangular plate piece, and is provided with a lock protrusion 3*b*1 in each end thereof in the width direction X. The plug terminal 3 can be fixed to the fixed housing 7 by press-fitting the fixed housing fixing portion 3*b* into the terminal fixing portion 7*i* of the plug housing 6 and having the lock protrusions 3*b*1 bite thereinto.

The movable pieces 3*c* are portions that elastically support the movable housing 8 so as to allow the movable housing 8 to be displaced with respect to the fixed housing 7. The movable piece 3*c* includes a first spring piece portion 3*c*1, a bent-back portion 3*c*2 that bends in a return direction, a second spring piece portion 3*c*1 that extends from an end portion of the bent-back portion 3*c*2, a bend portion 3*c*4 that bends in the front-rear direction Y, the inclined piece portion 3*c*5 that extends in the front-rear direction Y from the bend portion 3*c*4, and a bend portion 3*c*6 connected to the movable housing fixing portion 3*d*. Note that the inclined piece portion 3*c*5 is formed so that as the inclined piece portion 3*c*5 extends from the bend portion 3*c*6 positioned at the center side of the bottom wall portion 8*a*5 of the movable housing 8 towards the side wall portion 8*a*3 of the movable housing 8, the inclined piece portion 3*c*5 obliquely inclines so as to gradually be distanced away from the substrate serving as the "opposing surface".

The movable housing fixing portion 3*d* is formed as a substantially rectangular plate piece, and is provided with a lock protrusion 3*d*1 in each end thereof in the width direction X. The plug terminal 3 can be fixed to the movable housing 8 by press-fitting the movable housing fixing portion 3*d* into the terminal fixing hole 8*a*8 of the movable housing 8 and having the lock protrusions 3*d*1 bite thereinto.

The plug contact portions 3*e* are each formed as a metal plate extending in the width direction X and the height direction Z, and are held at the fitting recesses 8*a*7 of the middle wall 8*a*6. Each plug contact portions 3*e* is in conductive contact with the front contact portion 4*c*6 and the rear contact portion 4*d*10 of the corresponding socket terminal 4.

Functions and Effects of Socket Connector 1 and Plug Connector 2

The functions and effects of the socket connector 1 and the plug connector 2 according to the present exemplary embodiment configured in the above manner will be described next.

Figure 19:
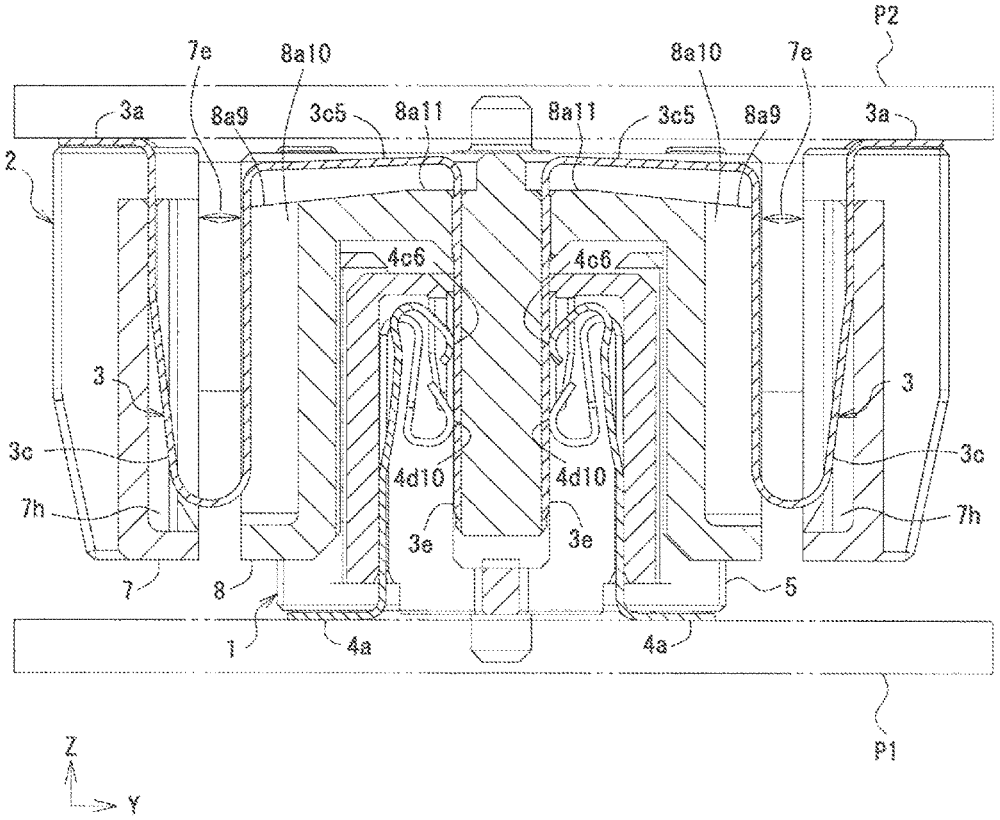
FIG. 19 is a cross-sectional view taken along line corresponding to IV-IV in FIG. 2 and illustrates a state in which the socket connector and the plug connector are fitted to each other.

Conductive Contact Through Fitting and Connection, and Two Contact Points: FIG. 19

The plug connector 2 is fitted to the socket connector 1. Specifically, the fitting portion 8*a* of the plug connector 2 is inserted into the fitting chamber 5*b*1 through the fitting hole 5*g* of the fitting portion 5*b* of the socket connector 1. With the above, the distal end sides of the plug contact portions 3*e* are inserted into the fitting chamber 5*b*1, come in contact with the front contact portions 4*c*6 after coming in contact with the front contact guide portions 4*c*5 of the socket terminals 4. Furthermore, when the plug connector 2 is pushed in, the plug contact portions 3*e* come in contact with the rear contact portions 4*d*10 after coming in contact with the rear contact guide portions 4*d*11. With the above, as illustrated in FIG. 19, the two points, that is, the front contact portions 4*c*6 and the rear contact portions 4*d*10, are in conducive contact with the plug contact portions 3*e*. With such conductive contact through two contact points, or conductive contact through at least one point, the contact reliability of the socket connector 1 can be increased.

Foreign Substance Removing Function

The front contact portion 4*c*6 and the rear contact portion 4*d*10 of each socket terminal 4 are arranged on a straight line extending in the insertion direction Z of the corresponding plug contact portion 3*e*. Accordingly, the front contact portions 4*c*6 remove the foreign substances, such as remains of the substrate, adhered on the plug contact portions 3*e*, and as if following the sliding routes, the rear contact portions 4*d*10 successively come in contact with the plug contact portions 3*e*. Even if there are foreign substances adhered to the plug contact portions 3*e*, the contact reliability of the socket connector 1 can be increased.

Figure 9:
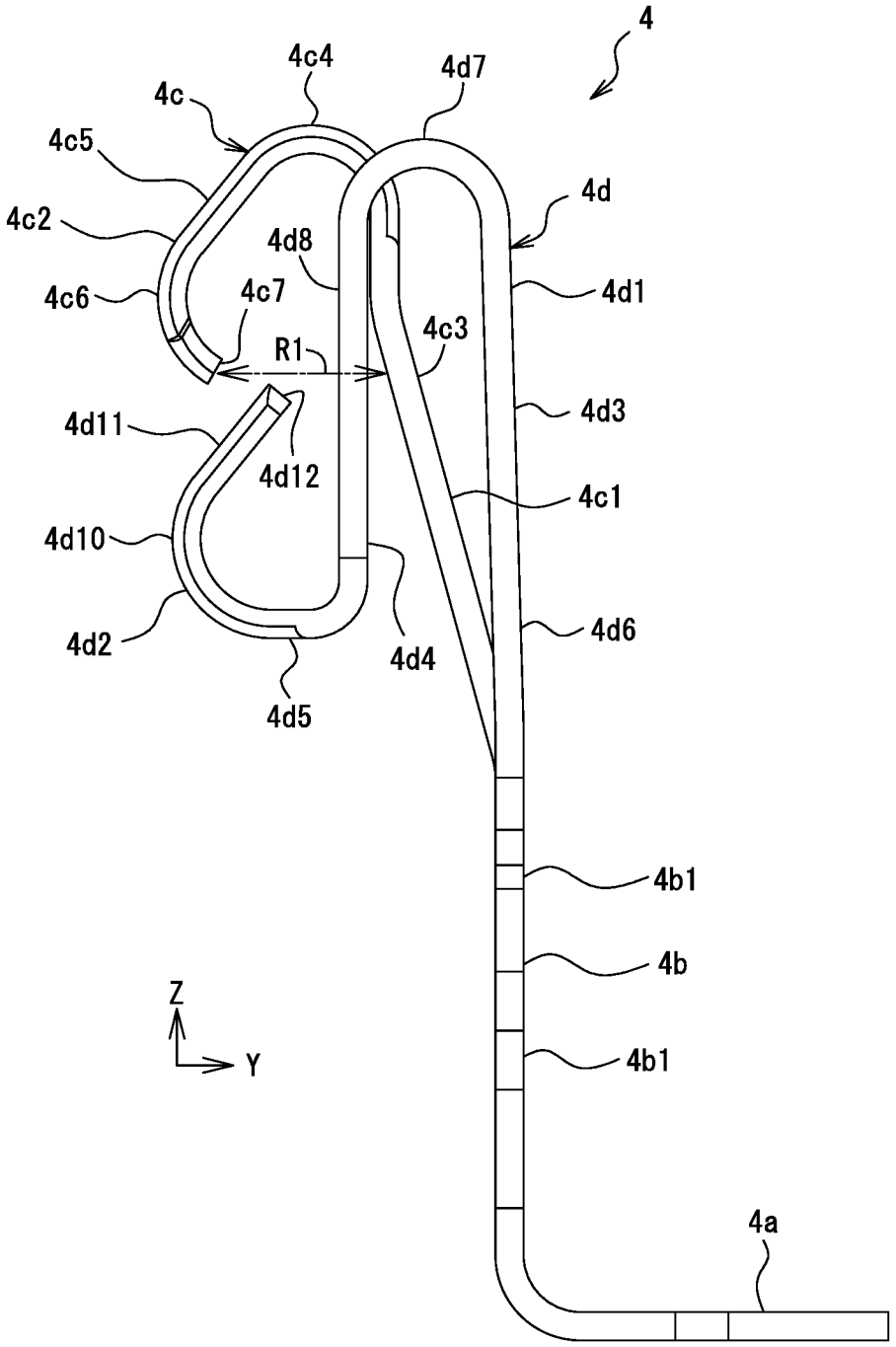
FIG. 9 is a right side view of the socket terminal in FIG. 7.
Figure 20:
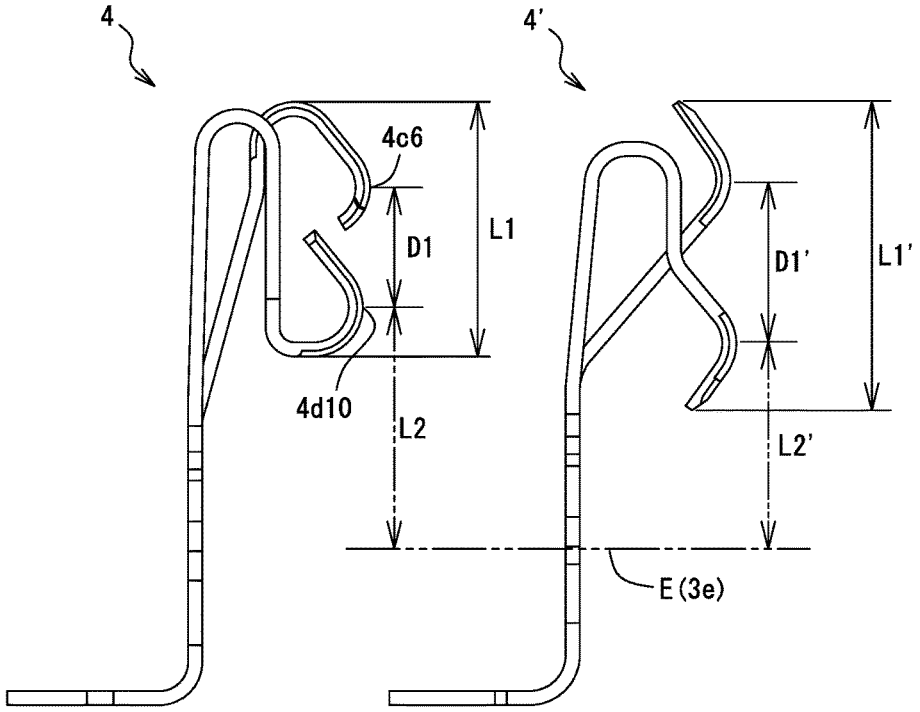
FIG. 20 illustrates explanatory drawings comparing a known socket terminal and the socket terminal of the present exemplary embodiment.

Reduction in Size and Increase in Effective Fitting Length: FIGS. 9 and 20

With the first bent-back portion 4*c*4 of the first terminal piece 4*c* and the third bent-back portion 4*d*5 of the second terminal piece 4*d*, the first contact portion 4*c*2 and the second contact portion 4*d*2 extend in the height direction Z so as to oppose each other. In other words, as illustrated in FIG. 9, the distal end portion 4*c*7 of the first contact portion 4*c*2 opposes the distal end portion 4*d*12 of the second contact portion 4*d*2 and, in the front-rear direction Y, the distal end portion 4*d*12 is in an area R1 between the distal end portion 4*c*7 and the first spring piece portion 4*c*3. When comparing such a socket terminal 4 and a known socket terminal 4' in which the first terminal piece and the second terminal piece extend in directions that are opposite to each other, as illustrated in FIG. 20, a distance D1 in the height direction Z between the point of contacts of the front contact portion 4*c*6 and the rear contact portion 4*d*10 can be made shorter than a distance D1' between the point of contacts of the known socket terminal. Furthermore, a length L1 of the first contact portion 4*c*2 and the second contact portion 4*d*2 in the height direction Z is shorter than the length L1' of the known socket terminal 4'. Moreover, when the distal end position of the plug contact portion 3*e* fitted in the plug terminal 3 in the insertion direction Z is indicated by a virtual line E (3*e*) and when the effective fitting lengths of the second terminal pieces 4*d* from the virtual line E are compared, then, the effective fitting length L2 of the second terminal piece 4*d* of the socket terminal 4 is longer than the effective fitting length L2' of the known socket terminal 4'. As described above, when compared with the known socket terminal, the socket terminal 4 of the present exemplary embodiment can be small in size (small in height), the terminal accommodating portion 5*b*2 of the socket housing 5 can also be small in size (small in height), and further, the socket connector 1 can be small in size (small in height). Furthermore, since the effective fitting length of the rear contact portion 4*d*10 can be increased, the contact reliability can be increased as well.

Figure 21:
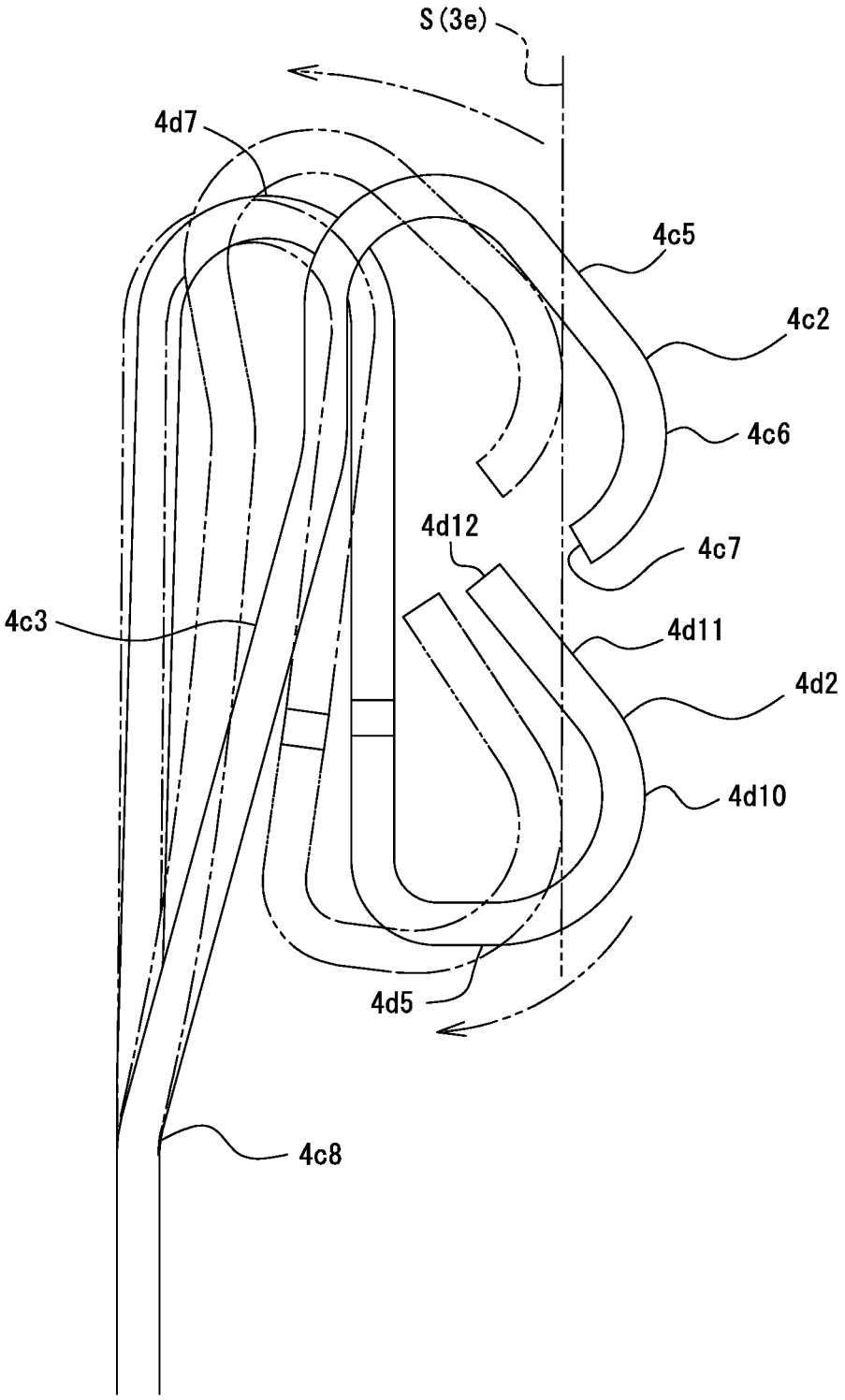
FIG. 21 is an explanatory drawing illustrating movements of displacement of the socket terminal in FIG. 7.

Interference Prevention Movement During Displacement of First Contact Portion 4*c*2 and Second Contact Portion 4*d*2: FIG. 21

As described above, the first contact portion 4*c*2 and the second contact portion 4*d*2 are close to each other and are at positions opposing each other in the height direction Z. When displaced by being pressed by the plug contact portion 3*e*, the first contact portion 4*c*2 and the second contact portion 4*d*2 rotate and are displaced so as to distance away from each other such that there is no interference between each other. FIG. 21 illustrates a virtual line S (3*e*) that is the contact surface of the plug contact portion 3*e* in a fitted state and in contact with the front contact portion 4*c*6 and the rear contact portion 4*d*10. The first contact portion 4*c*2 is, as illustrated in FIG. 21, displaced upwards in a rotating manner about the base end side of the first spring piece portion 4*c*3 as the spring fulcrum when receiving the pressing force of the plug contact portion 3*e*. On the other hand, as illustrated in FIG. 21, the second contact portion 4*d*2 is, as described later, displaced downwards in a rotating manner about the second bent-back portion 4*d*7 as the spring fulcrum. Accordingly, the first contact portion 4*c*2 and the second contact portion 4*d*2, in particular, the distal end portions 4*c*7 and 4*d*12 do not interfere with each other even when displaced.

Obtaining Spring Lengths of First Terminal Piece 4*c* and Second Terminal Piece 4*d*

Since the first terminal piece 4*c* includes the first bent-back portion 4*c*4, and the second terminal piece 4*d* includes the second bent-back portion 4*d*7, the intermediate spring piece 4*d*8, and the third bent-back portion 4*d*5, when compared with the known socket terminal (see FIG. 20), long spring lengths can be obtained in the first terminal piece 4*c* and the second terminal piece 4*d* and stress can be dispersed; accordingly, spring durability can be provided.

Prevention of Buckling of Second Terminal Piece 4*d*

The distal end portion 4*d*12 of the second contact portion 4*d*2 is positioned closer to the first spring piece portion 4*c*3 than the distal end portion 4*c*7 of the first contact portion 4*c*2. With the above, the distal end portion 4*d*12 of the second contact portion 4*d*2 is hidden by the first contact portion 4*c*2 from the inserted plug terminal 3. Accordingly, the buckling and braking caused by the plug terminal 3 being caught by the distal end portion 4*d*12 of the second contact portion 4*d*2 can be prevented.

Exerting Contact Pressure of Second Terminal Piece 4*d* Using Displacement Restriction Wall 5*b*8

Displacement restriction walls 5*b*8 are formed in the socket housing 5. When the plug terminals 3 come in contact with and presses the rear contact guide portions 4*d*11 and the rear contact portions 4*d*10, and push the rear contact guide portions 4*d*11 and the rear contact portions 4*d*10 into the terminal accommodating portions 5*b*2, the third bent-back portions 4*d*5 are displaced so as to retract into the terminal accommodating portions 5*b*2 with the flexing of the intermediate spring pieces 4*d*8 supported by the second bent-back portions 4*d*7. Together with the displacement, the second bent-back portions 4*d*7 are, opposite to the above, rotated and displaced towards the fitting chamber 5*b*1 with the base end sides of the base end spring pieces 4*d*6 as the main spring fulcrum, and the second bent-back portions 4*d*7 abutting against the displacement restriction walls 5*b*8 are stopped from being rotated and displaced. In the above case, if no displacement restriction walls 5*b*8 are provided, the second bent-back portions 4*d*7 are, without any change, rotated and displaced so as to protrude into the fitting chamber 5*b*1 such that the contact pressures of the second contact portions 4*d*2 are decreased. However, in the present exemplary embodiment, rotation and displacement of the second bent-back portions 4*d*7 are stopped by the displacement restriction walls 5*b*8 and, with the above, the second bent-back portions 4*d*7 function as the main spring fulcrums of the intermediate spring pieces 4*d*8, the third bent-back portions 4*d*5, and the second contact portions 4*d*2, such that contact pressures that reliably press and contact the second contact portions 4*d*2 against the plug terminals 3 are exerted. With the above, in the present exemplary embodiment, in the fitted and connected state, the second contact portions 4*d*2 and the plug terminals 3 can be reliably in conductive contact with each other while obtaining the spring length, which disperses the stress, in the second terminal pieces 4*d*.

Furthermore, as illustrated in FIG. 10, the narrow width portions 4*d*9 that have a plate width narrower than the plate width W2 on the distal end side connected to the second bent-back portion 4*d*7 are formed in the base end spring pieces 4*d*6 described above on the base end side that is a side opposite to the second bent-back portion 4*d*7. The narrow width portions 4*d*9 are formed so that the plate width becomes gradually narrower from the distal end side. The area of the base end spring piece 4*d*6 on the base end side is the area having the plate width W1 that is most narrow. Accordingly, due to the soft narrow width portions 4*d*9, the second bent-back portions 4*d*7 are rotated and displaced with a small force such that the second bent-back portions 4*d*7 are in contact with the displacement restriction walls 5*b*8 at an early stage in the fitting and connecting process. With the above, each second contact portion 4*d*2 can be in conductive contact with the corresponding plug terminal 3 in a reliable manner at an early stage in the fitting and connecting process with the corresponding second bent-back portion 4*d*7 as the spring fulcrum. Furthermore, since each narrow width portion 4*d*9 is shaped so as to become gradually narrower from the distal end side of the corresponding base end spring piece 4*d*6 towards the corresponding area on the base end side with plate width W1, the overall base end spring piece 4*d*6 can be displaced softly.

Figure 22:
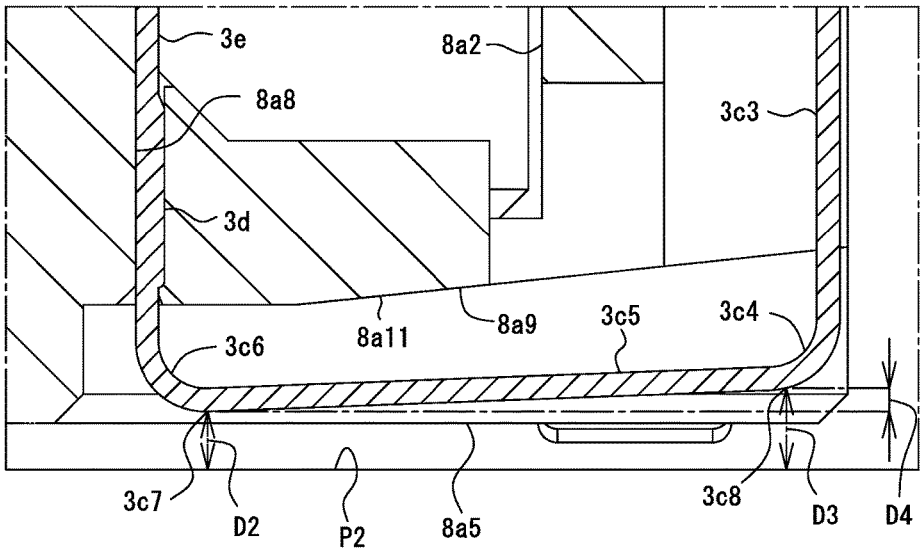
FIG. 22 is an explanatory drawing of an area A in FIG. 17 and illustrates a movement of an inclined piece portion of the plug terminal.

Response of Inclined Piece Portions 3*c*5 of Movable Pieces 3*c* of Plug Terminals 3 to Tilting of Movable Housing 8: FIG. 22

The inclined piece portions 3*c*5 that obliquely extend so as to gradually be distanced away from the opposing surface of the substrate P2 opposing the bottom wall portion 8*a*5 are formed in the movable pieces 3*c* of the plug terminals 3 from the middle side of the bottom wall portion 8*a*5 of the movable housing 8 towards the side wall portions 8*a*3. As illustrated in FIG. 22, movable spaces D4 amounting to the inclination of the inclined piece portions 3*c*5 are provided between the gaps D2 between lower side inclination end portions 3*c*7 of the inclined piece portions 3*c*5 and the substrate P2, and the spaces D3 between upper side inclination end portions 3*c*8 and the substrate P2. Accordingly, for example, when fitting and connecting the movable housing 8 and the socket connector 1 to each other, even if the movable housing 8 is rotated and tilted about an axis extending in the width direction X, the upper side inclination end portions 3*c*8 of the inclined piece portions 3*c*5 that are, by the tilting, displaced more than the middle side of the movable housing 8 are distanced more away from the substrate P2 by the distance amounting to the movable space D4 that is the amount of inclination; accordingly, cases in which damage is caused by impingement against the substrate P2 can be reduced. Furthermore, even if the movable housing 8 is tilted while in a state in which the plug connector 2 and the socket connector 1 are fitted and connected to each other, since the inclined piece portions 3*c*5 are distanced more away from the substrate P2 by the distance amounting to the movable space D4 that is the amount of inclination, movable spaces corresponding to the designed displacement amount of the movable housing 8 can be obtained between the inclined piece portions 3*c*5 and the substrate P2.

Furthermore, the inclined surface portions 8*a*9 that extend obliquely along the inclined piece portions 3*c*5 of the movable pieces 3*c* are formed in the bottom wall portion 8*a*5 of the movable housing 8 from the middle side towards the outer edge side. Accordingly, the inclined piece portions 3*c*5 can be disposed along the bottom wall portion 8*a*5 while obtaining a predetermined amount of movable spaces between the bottom wall portion 8*a*5 of the movable housing 8.

Figure 23:
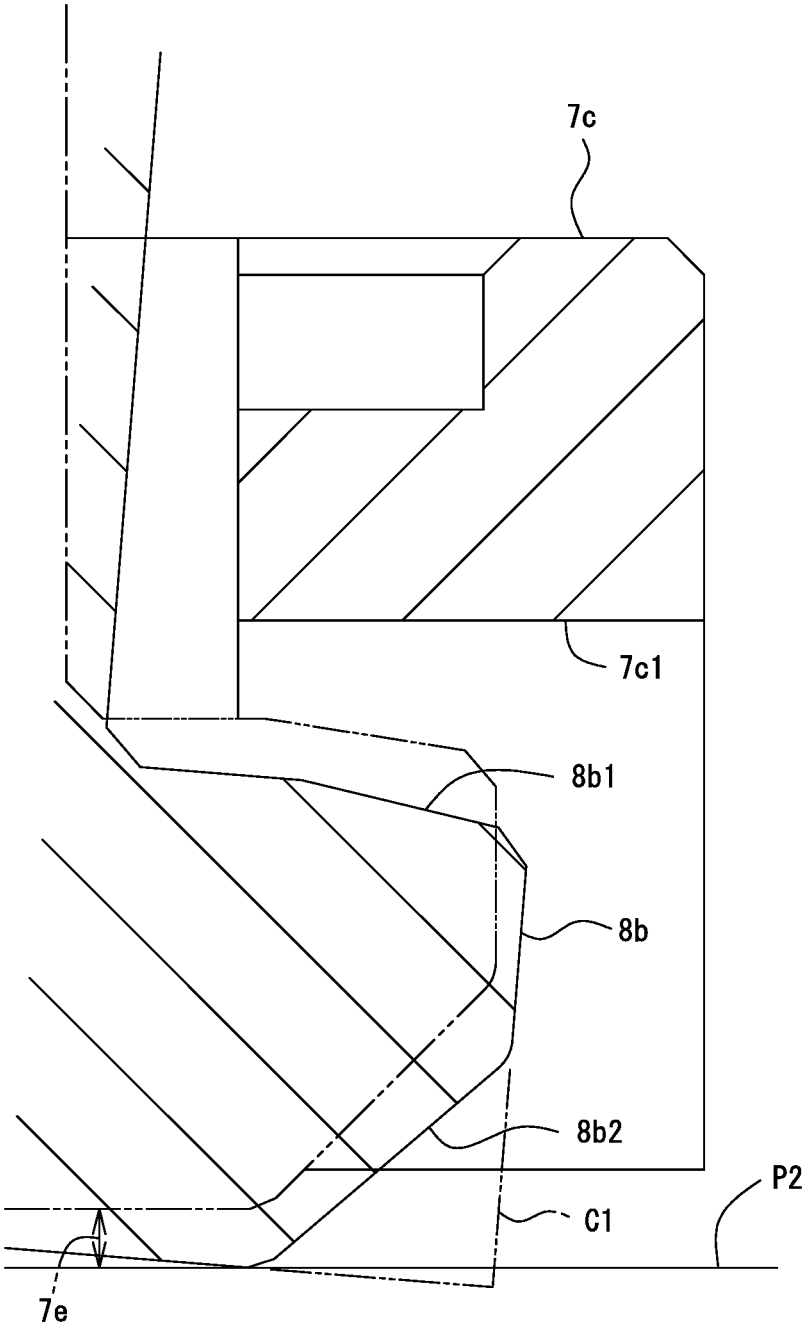
FIG. 23 is an explanatory drawing of an area B in FIG. 16 and illustrates a movement of a displacement restricting protrusion.
Figure 24:
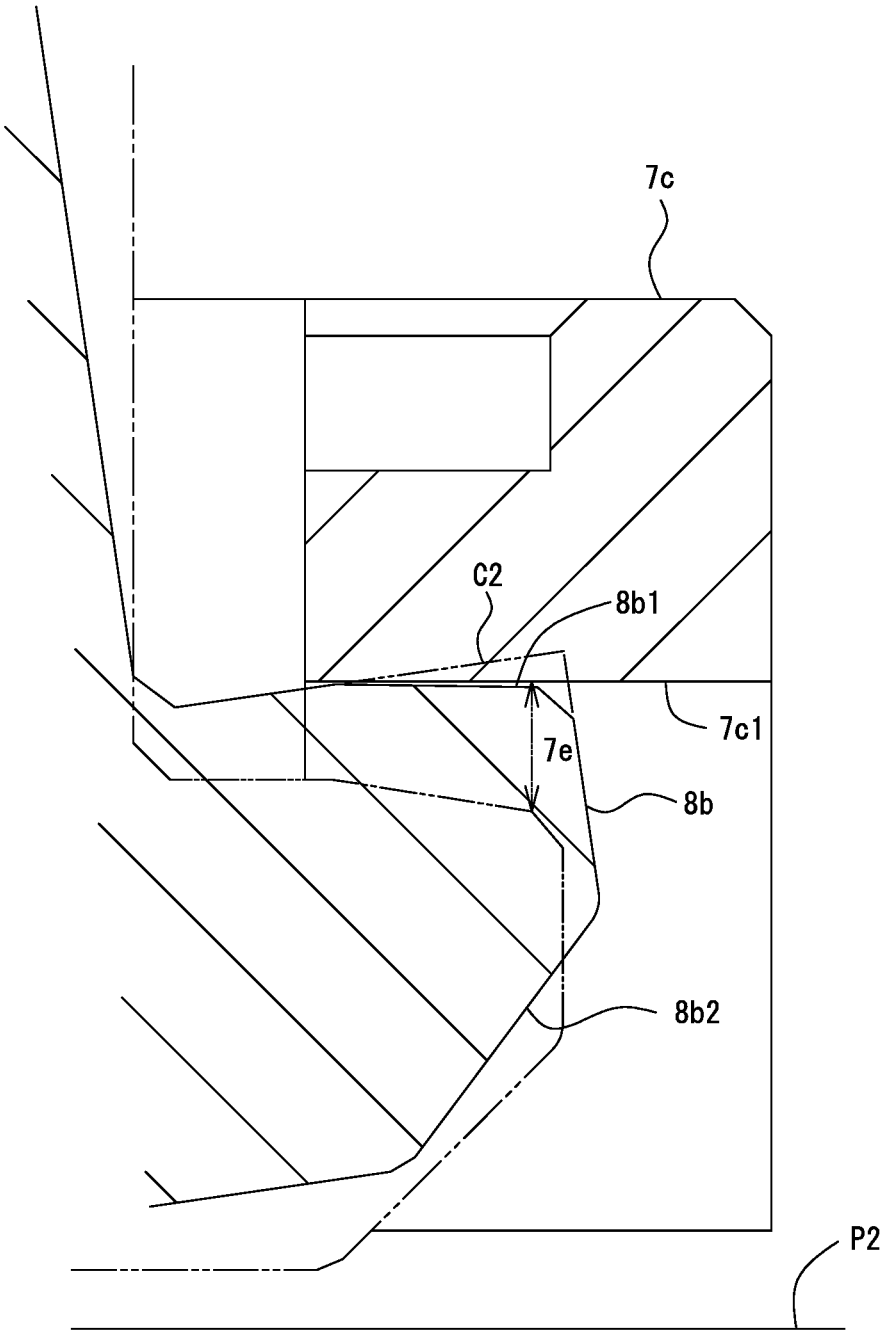
FIG. 24 is an explanatory drawing of the area B in FIG. 16 and illustrates another movement of the displacement restricting protrusion.

Displacement Restricting Protrusions 8*b* of Movable Housing 8: FIGS. 23 and 24

The upper portion inclined surfaces 8*b*1 and the lower portion inclined surfaces 8*b*2 are formed in the displacement restricting protrusions 8*b*. The upper portion inclined surfaces 8*b*1 and the lower portion inclined surfaces 8*b*2 are formed by obliquely removing the outside corner edges (shapes C1 and C2 of the corner edges illustrated by two-dot chain lines in FIGS. 23 and 24) of the displacement restricting protrusions 8*b* in a case in which the displacement restricting protrusions 8*b* have rectangular parallelepiped shapes. In a case in which the shapes C1 and C2 of the corner edges exist, the corner edges abut against the substrate P2 even with a slight tilting of the movable housing 8; accordingly, in order to prevent the above, the largest displacement amount caused by tilting of the movable housing 8 needs to be suppressed to a small amount. According to the configuration of the present exemplary embodiment, movable spaces amounting to the inclination can be increased between the upper portion inclined surfaces 8*b*1 of the displacement restricting protrusions 8*b* and the locking recesses 7*c*1 of the fixed housing 7. Meanwhile, movable spaces amounting to the inclination can be increased between the lower portion inclined surfaces 8*b*2 and the substrate P2 as well. Accordingly, compared with a case with no movable spaces, the largest displacement amount caused by tilting of the movable housing 8 can be increased.

Modifications of Exemplary Embodiment

In the exemplary embodiment described above, regarding the socket terminals 4 of the socket connector 1, an exemplification of the second terminal pieces 4*d* each having two spring portions 4*d*3 has been given; however, the number of spring portions 4*d*3 may be one.

In the exemplary embodiment described above, an example in which the displacement restriction walls 5*b*8 of the socket housing 5 of the socket connector 1 are provided on both sides of the opening 5*i* has been given; however, the displacement restriction walls 5*b*8 may be provided on one side.

In the exemplary embodiment described above, a mode in which both the upper portion inclined surfaces 8*b*1 and the lower portion inclined surfaces 8*b*2 are provided in the displacement restricting protrusions 8*b* of the movable housing 8 of the plug connector 2 has been exemplified; however, only either one may be provided in the displacement restricting protrusions 8*b*.

In the exemplary embodiment described above, an example in which the fixed housing 7 of the plug connector 2 includes the bottom surface opening 7*g* has been given; however, the fixed housing may have a bottom wall portion. In such a case, the inclined piece portions 3*c*5 of the plug terminals 3 may be formed so as to extend in an oblique manner and to be distanced away gradually from the bottom wall portion of the fixed housing serving as an opposing surface.

What is claimed is:

1. A movable connector comprising:

a fixed housing fixed to a substrate;

a movable housing fitted and connected to an object to be connected; and a terminal including a fixed housing fixing portion fixed to the fixed housing, a movable housing fixing portion fixed to the movable housing, and a movable piece that is located between the fixed housing fixing portion and the movable housing fixing portion and that elastically supports the movable housing so as to allow the movable housing to be displaced with respect to the fixed housing, wherein the movable piece includes a first spring piece portion that extends in a direction away from the substrate, a bent-back portion that bends from the first spring piece in a return direction, a second spring piece portion that extends toward the substrate from the bent-back portion, a first bend portion that bends from the second spring piece portion along the substrate or an opposing surface of the fixed housing that opposes a bottom surface of the movable housing, an inclined piece portion that extends along the substrate or the opposing surface from the first bend portion, and a second bend portion that bends from the inclined piece portion in the direction away from the substrate, and wherein the inclined piece portion obliquely extends from a middle side of the bottom surface of the movable housing toward a lateral surface of the movable housing so as to gradually be distanced away from an opposing surface of the substrate or the opposing surface of the fixed housing that opposes the bottom surface.

2. The movable connector according to claim 1, wherein the movable housing includes a bottom wall that forms the bottom surface, and wherein the bottom wall includes an inclined surface portion that obliquely extends from a middle side thereof towards the outer edge side thereof along the inclined piece portion.

3. The movable connector according to claim 1, wherein the movable housing includes a displacement restricting protrusion that opposes at least the fixed housing or the substrate, and wherein the displacement restricting protrusion includes a corner edge absent portion in at least a surface opposing the fixed housing or a surface opposing the substrate.

4. The movable connector according to claim 1, wherein the fixed housing includes an accommodation portion that accommodates the movable housing and that surrounds the lateral surface.

5. The movable connector according to claim 1, wherein the inclined piece portion includes a lower side inclination end portion that connects to the second bend portion and that opposes the substrate or the opposing surface, and an upper side inclination end portion that connects to the first bend portion and being distanced more away from the substrate or the opposing surface than the lower side inclination end portion.

6. The movable connector according to claim 4, wherein the second spring piece portion, the first bend portion, the inclined piece portion and the second bend portion are located in the movable housing.

* * * * *